US011841208B1

(12) United States Patent
Roth

(10) Patent No.: US 11,841,208 B1
(45) Date of Patent: Dec. 12, 2023

(54) UNIVERSALLY ADJUSTABLE FIREARM STOCK

(71) Applicant: Mark John Roth, Appleton, WI (US)

(72) Inventor: Mark John Roth, Appleton, WI (US)

( * ) Notice: Subject to any disclaimer, the term of this patent is extended or adjusted under 35 U.S.C. 154(b) by 23 days.

(21) Appl. No.: 17/356,205

(22) Filed: Jun. 23, 2021

Related U.S. Application Data

(60) Provisional application No. 63/043,337, filed on Jun. 24, 2020.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/20
See application file for complete search history.

(56) References Cited

U.S. PATENT DOCUMENTS

| | | | | |
|---|---|---|---|---|
| 1,063,061 | A | 5/1913 | Pickering | |
| 1,468,354 | A | 9/1923 | Caretto | |
| 2,121,982 | A | 6/1938 | Pugsley | |
| 4,589,219 | A | 5/1986 | Milliman | |
| 5,031,348 | A | 7/1991 | Carey | |
| 5,392,553 | A | 2/1995 | Carey | |
| 5,410,833 | A | 5/1995 | Paterson | |
| 5,933,997 | A | 8/1999 | Barrett | |
| 6,457,273 | B2 | 10/2002 | Gussalli Beretta | |
| 7,104,002 | B2 | 9/2006 | Rotundo | |
| 7,681,351 | B2 | 3/2010 | Bucholtz et al. | |
| 7,748,154 | B2 | 7/2010 | Moretti | |
| 7,823,315 | B2 | 11/2010 | Webber et al. | |
| 7,984,580 | B1 | 7/2011 | Giauque et al. | |
| 8,720,099 | B1 * | 5/2014 | Sisk | F41C 23/14 42/73 |
| 10,317,165 | B2 | 6/2019 | Saltzman | |
| D880,641 | S | 4/2020 | Huagen | |
| D891,561 | S | 7/2020 | Parker et al. | |
| 11,035,644 | B2 * | 6/2021 | Moretti | F41C 23/14 |
| 2007/0089347 | A1 | 4/2007 | Webber et al. | |
| 2008/0028662 | A1 | 2/2008 | Abraham et al. | |
| 2018/0180378 | A1 | 6/2018 | Pretelli et al. | |

OTHER PUBLICATIONS

Precision Fit Stocks a Division of Target Shotguns Inc., Precision Fit Stock Instructions and Installation, date unknown (viewed May 4, 2020), 18 pages.

* cited by examiner

*Primary Examiner* — J. Woodrow Eldred
(74) *Attorney, Agent, or Firm* — Brannen Law Office, LLC

(57) ABSTRACT

A universally adjustable firearm stock is provided having adjustments for comb, cast, length of pull and butt pad height. The stock has an adapter (receiver model specific) to connect a frame to the receiver. An end of a mount passes through a slot through a frame seat. A cast piece is received within the seat and has a cast hole (center hole—no cast, offset hole—cast). The rearward extending end of the mount passes through the cast hole, wherein any offset in the cast hole results in an angular cast. The comb is vertically adjustable relative to the frame. Two rods are extendable relative to the frame to adjust the length of pull. A butt plate has two slots wherein the height of a butt pad relative to the rods is adjustable.

7 Claims, 22 Drawing Sheets

UNIVERSALLY ADJUSTABLE FIREARM STOCK

This United States utility patent application claims priority on and the benefit of provisional application 63/043,337 filed Jun. 24, 2020, the entire contents of which are hereby incorporated herein by reference.

BACKGROUND OF THE INVENTION

1. Field of the Invention

The present invention relates to a universally adjustable firearm stock having adjustments for comb, cast, length of pull and butt pad height.

2. Description of the Related Art

Firearms including shotguns have existed for many years. Many people use a shotgun in its original configuration without adjustment. Yet, for many others, making custom adjustments to the fit of the firearm results in a more accurate and a more comfortable shooting experience.

Several aspects of a shotgun stock can be adjusted.

For example, an adjustable comb can be used to adjust the height of the cheek rest in relation to the bore axis of the barrel. Adjusting the height of the cheek rest allows user to custom fit their face to the firearm and also provides sight clearance for the user to add optical or other components without obstruction to the user.

A user can also adjust the length of pull of the firearm. This is typically done by adjusting the length of the stock. This allows both smaller and larger individuals to use the same firearm. Further, it allows children to use the same firearm as they grow as the length of the stock could be adjusted to optimal length as the child grows.

A third adjustment that can be made is to cast. Cast adjustments allow the user to offset the stock center from the bore center axis. One example of cast is movement in a lateral manner (i.e. perpendicular to the bore axis). This allows the user to comfortably position their eyes to a more appropriate position in relation to the bore axis. Cast can be cast off or cast on depending upon the movement stock in relation to the bore axis. Alternatively, in the past, shims have been used between the receiver and the stock to pivot the stock axis in relation to the bore axis.

A fourth adjustment that can be made is to the butt cap. The cap can be moved higher or lower in relation to the stock for comfort.

While each of these adjustments are known generally in the industry, there still exists a need for a universally adjustable firearm stock that contains the novel features of inventions contained herein.

Thus, there exists a need for a universally adjustable firearm stock that solves these and other problems.

SUMMARY OF THE INVENTION

A universally adjustable firearm stock is provided having adjustments for comb, cast, length of pull and butt pad height. The stock has an adapter (receiver model specific) to connect a frame to the receiver. An end of a mount passes through a slot through a frame seat. A cast piece is received within the seat and has a cast hole (center hole—no cast, offset hole—cast). The rearward extending end of the mount passes through the cast hole, wherein any offset in the cast hole results in an angular cast. The comb is vertically adjustable relative to the frame. Two rods are extendable relative to the frame to adjust the length of pull. A butt plate has two slots wherein the height of a butt pad relative to the rods is adjustable.

According to one advantage of the present invention, the stock offers a full range of motion adjustability within a single device, by having adjustments for comb height, angular cast, length of pull and butt pad height.

According to another advantage of the present invention, the four adjustments are made without the need for any additional parts such as spacers, shims or risers.

According to further advantage of the present invention, the adjustments are not permanent, and are made without making any permanent alterations to the aftermarket stock.

According to a still further advantage yet of the present invention, the adjustments for comb height, angular cast, length of pull and butt pad height are each independently adjustable.

According to a still further advantage yet of the present invention, a firearm receiver specific adapter can be used to connect the frame of the stock to the receiver. In this regard, the frame can be used with receivers from many manufactures by using the correct adapter making the stock a universal aftermarket stock for many firearms.

According to a still further advantage yet of the present invention, the stock is secured to a mount. In one embodiment, the mount is a buffer tube with an end cap having a rearward projecting end. In another embodiment, the mount is a rod that is secured to the receiver. In this regard, the present invention is useful with many styles of firearms.

According to a still further advantage yet of the present invention, the stock has an angular cast adjustment. This is advantageous as the firearm can be adjusted so that a user can engage the stock, whereby he or she can look down the barrel longitudinal axis.

The angular cast adjustment of the present invention can be made without shims thereby eliminating components required in the past. In this regard, the frame can be positioned to an angle relative to the buffer tube with a cast piece that can be seated upon the frame. Different cast pieces can be interchangeably provided whereby cast adjustments can be made without altering the frame. In this regard, in this embodiment, the frame can have a slot through which end cap passes. The cast piece determines, based on the location of a cast hole, where within the slot the cap passes and hence the angular adjustment of the stock relative to the barrel axis.

According to a still further advantage of one embodiment of the present invention, the adapter can be slightly compressible. This results in a flush engagement, without gaps, between the adapter rear face and the frame riser front face regardless of cast adjustment.

The tabs of the present invention have a radiused or round front end that are received in pockets having radiused or round profiles. The geometric center of the round tab front end defines a pivot axis upon which the frame is rotatable relative to the adapter. Full radial contact between the tabs and pockets is maintained regardless of cast angle.

Similarly, in another embodiment of the present invention, the front face of the frame is rounded to be rotatably received within an adapter.

According to a still further advantage yet of the present invention, the butt plate, and hence the butt pad, is vertically adjustable relative to the rods and frame. This is advantageously accomplished as the butt pad is removable from the butt plate, and the butt plate has two slots formed therethrough. Screws or other fasteners can pass through the slots and through a rod anchor into two rods to lock the position of the butt plate relative to the rods.

According to a still further advantage yet of the present invention, the rod anchor has a front face with pockets that stationarily receive and anchor the rods relative to the rod anchor. Fastener holes extend through the rear face to the center of the pockets.

According to a still further advantage yet of the present invention, the rods are adjustably movable along their longitudinal axis relative to the frame. This is advantageously accomplished by moving the rods through passages in the frame and using pegs to lock the rods in selected positions.

According to a still further advantage yet of the present invention, the comb is vertically adjustable relative to the frame. This is advantageously accomplished with fasteners that pass though fastener passages in the frame. Each fastener advantageously comprises of two pieces that can be selectably twisted relative to each other to shorten or lengthen the fastener. When shortened, the fastener can compress and secure the comb in position relative to the frame.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
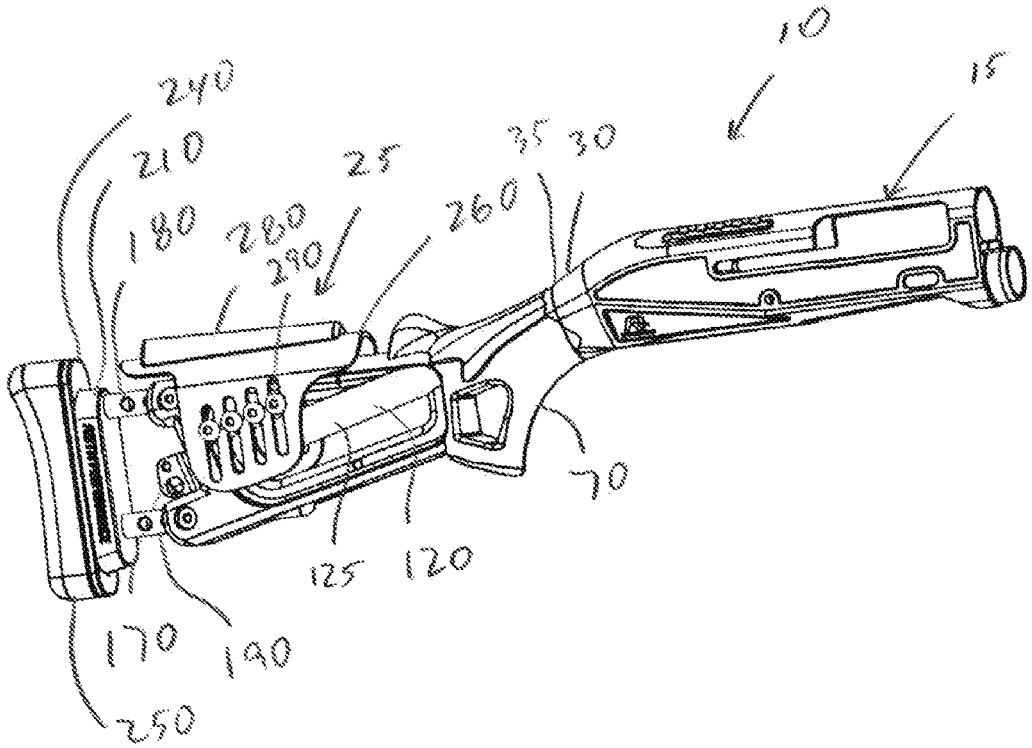
FIG. 1 is a perspective view showing a stock and a receiver.
Figure 2:
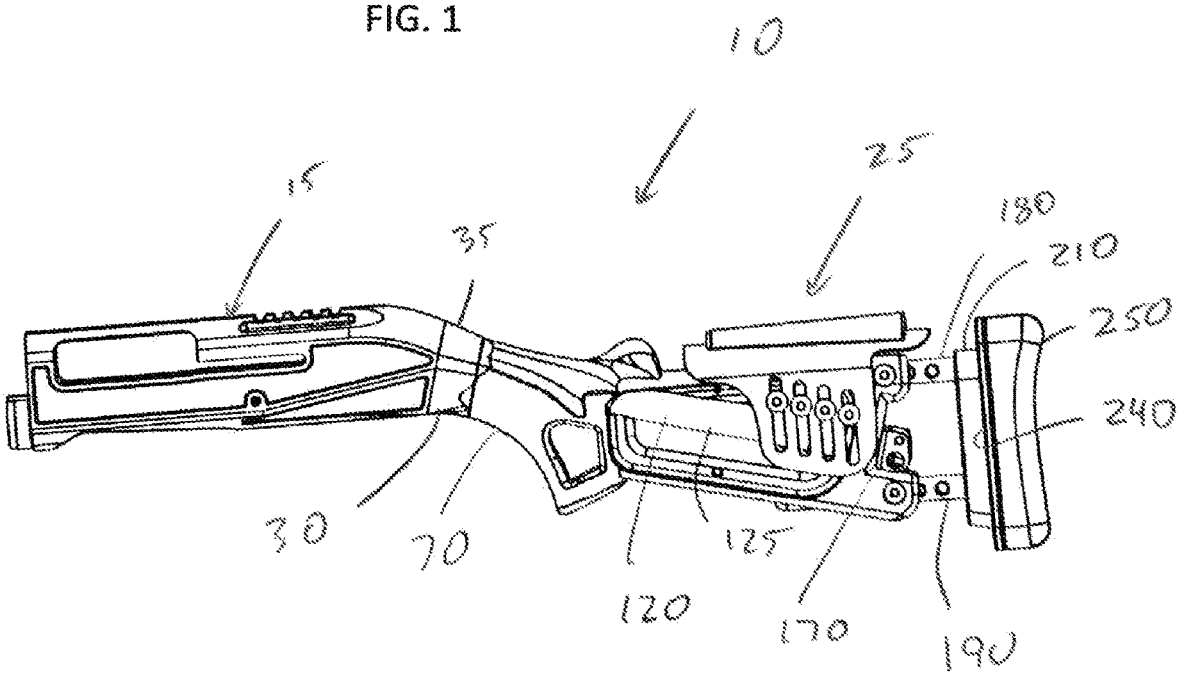
FIG. 2 is a reverse perspective view of the illustration shown in FIG. 1.
Figure 3:
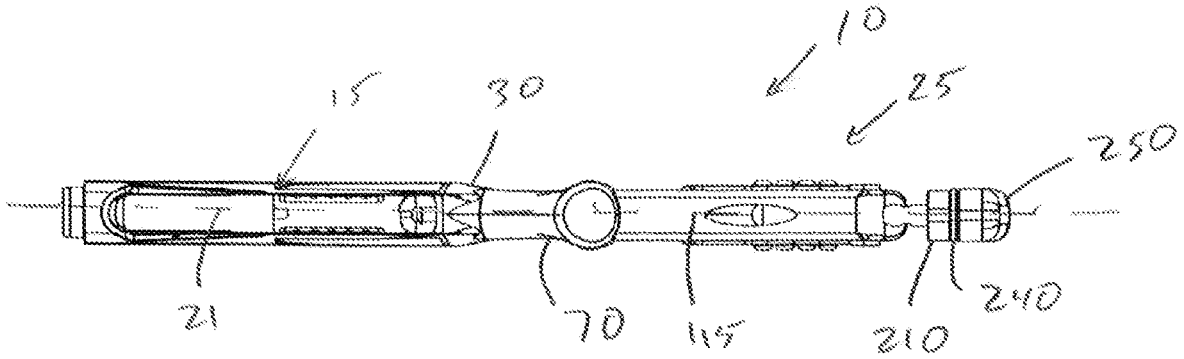
FIG. 3 is a bottom view of the illustration shown in FIG. 1.
Figure 4:
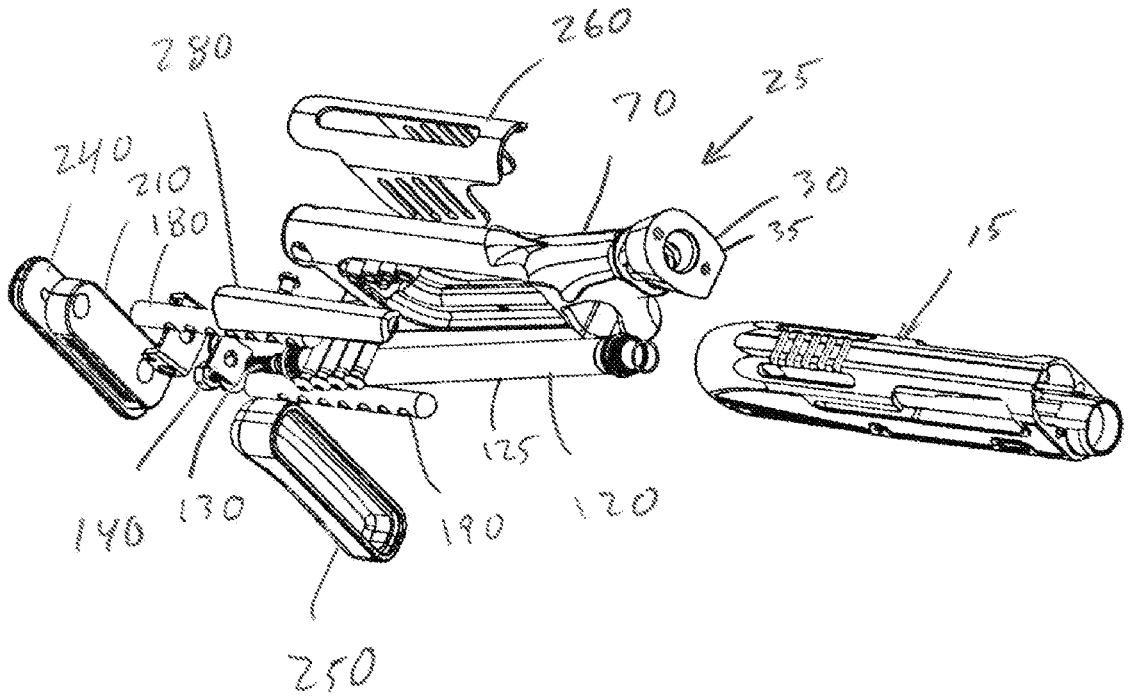
FIG. 4 is an exploded view of the illustration shown in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-4, it is seen that an embodiment of a stock 25 of the present invention is illustrated with a firearm 10 having a receiver 15. The receiver 15 has a first end 16 and a second end 17. The second end 17 has a rear face 18 with rear face holes 19 and 20. The receiver 15 has a center line 21 along its central axis.

The stock 25 has an adapter 35, a frame 70, a cast piece 140, a first rod 180, a second rod 190, a rod anchor 210, a butt plate 240, a butt pad 250, a comb 260 and a cheek riser 280. It is understood that not all of these components are necessary to operate the different features of the present invention. The stock can be adjusted in at least four different ways and not all of these components are necessary to make each adjustment.

A cast system 30 can utilize the adapter 35, the frame 70, a cast piece 140, and a mount 120.

Figure 5:
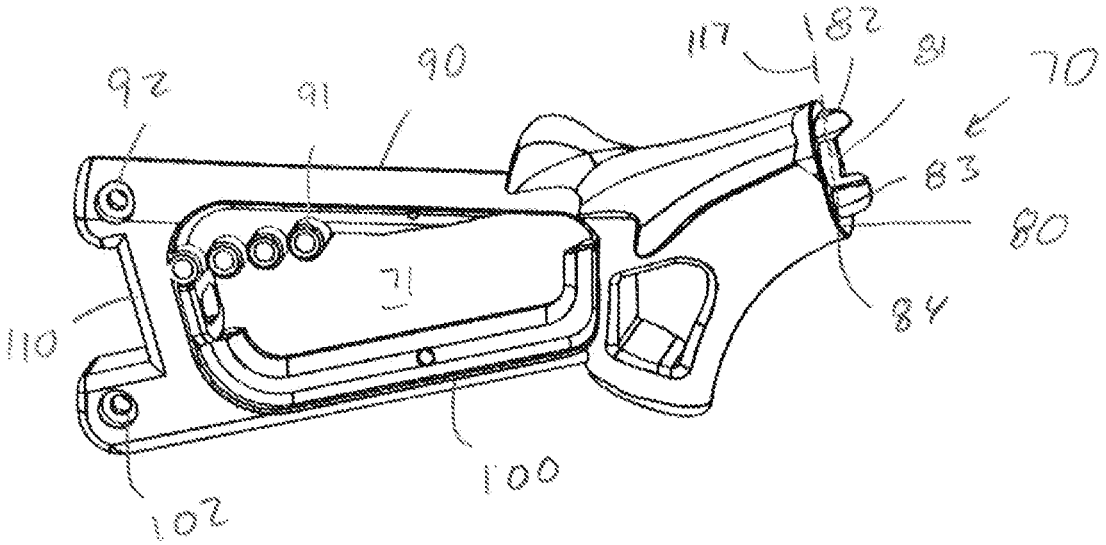
FIG. 5 is a perspective view of an embodiment of a frame of the present invention.
Figure 6:
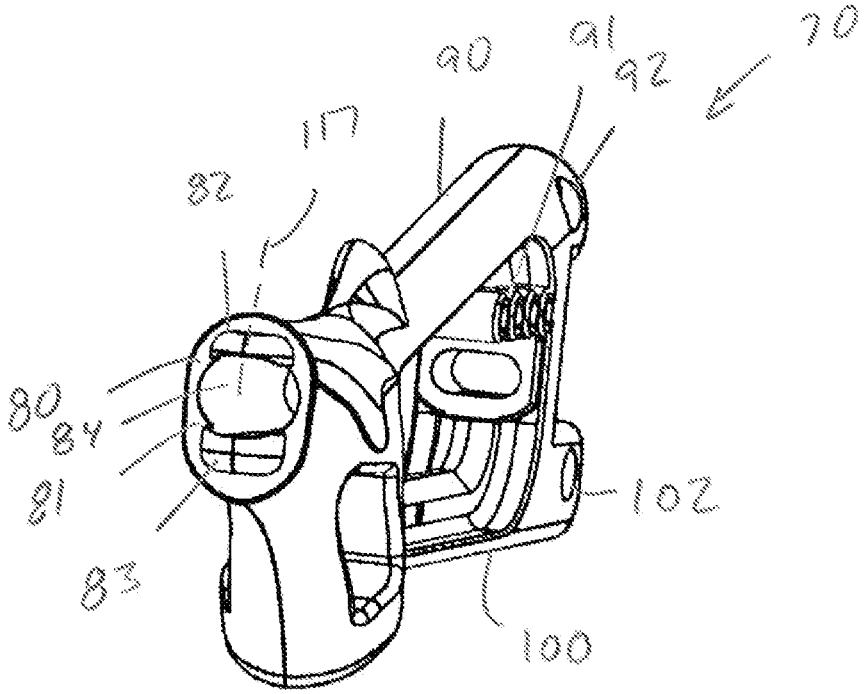
FIG. 6 is an alternative perspective view of the frame illustrated in FIG. 5.
Figure 7:
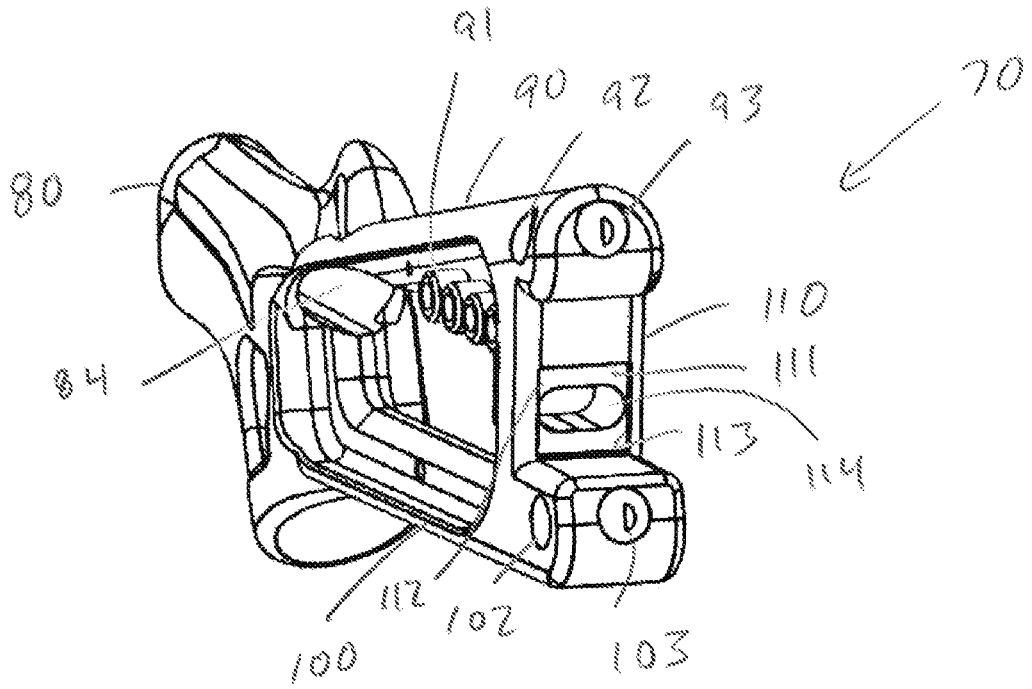
FIG. 7 is an alternative perspective view of the frame illustrated in FIG. 5.

A preferred embodiment of the frame 70 is illustrated in FIGS. 5-7. The frame is preferably an integrally formed piece. The frame 70 has a central opening 71. A front riser 80, a top 90, a bottom 100 and a rear riser 110 surround the central opening 71. The central opening is open to both sides of the frame 70. The front riser 80 has a face 81 with an upper tab 82 and a lower tab 83. Tabs 82 and 83 have round front ends. The round front ends each have a geometric center of the rounded portion. The geometric center of tab 82 defines a pivot axis 117, discussed below. A mount or buffer tube passage 84 passes through the front riser 80 between front face 81 and central opening 71. The buffer tube passage 84 is between the upper tab 82 and lower tab 83. The top 90 has a front end and a rear end. Fastener passages 91 are supported by the top 90 and are oriented laterally across the frame 70. While four passages are illustrated, it is appreciated that there may be more or less without departing from the broad aspects of the present invention. In a preferred embodiment, there are two fastener passages. The top 90 has a peg hole 92 at the top rear end. The peg hole 92 is laterally oriented through the frame 70. A rod passage 93 is longitudinally oriented through a portion of the top 90 and is open to the top rear end. The bottom 100 has a front end and a rear end. The bottom 100 has a peg hole 102 at the bottom rear end. The peg hole 102 is laterally oriented through the frame 70. A rod passage 103 is longitudinally oriented through the frame 70 and is open to the bottom rear end and bottom surface of the bottom 100. The top front and bottom front are integrally formed with the front riser. The rear riser 110 spans between the top 90 and bottom 100. The top rear end and bottom rear end preferably extend rearward beyond the rear riser 100. The rear riser 110 has a seat 111 with a top, a bottom, a first sidewall 112 and a second sidewall 113. A lateral slot 114 passes between the seat 111 and the central opening 71. The frame 70 has a centerline 115 along its longitudinal axis.

Figure 8:
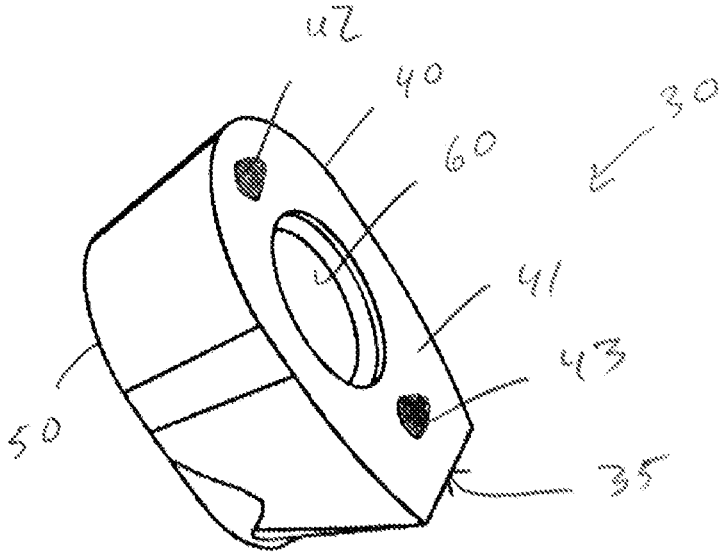
FIG. 8 is a perspective view of an embodiment of an adapter of the present invention.
Figure 9:
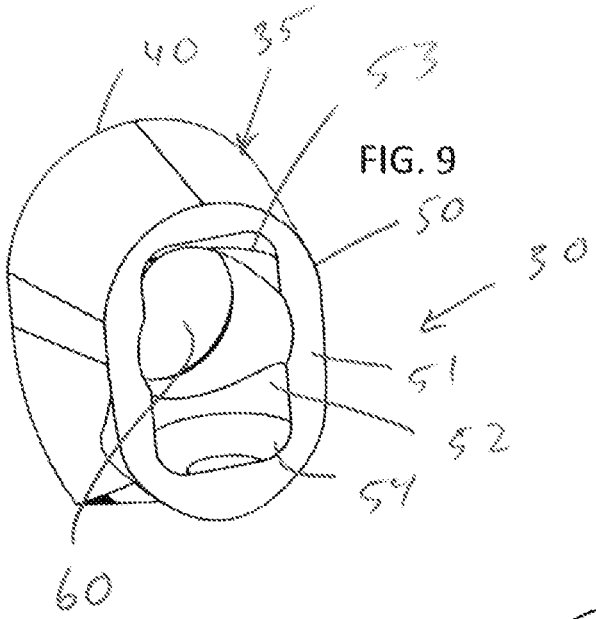
FIG. 9 is an alternative perspective view of the adapter illustrated in FIG. 8.
Figure 10:
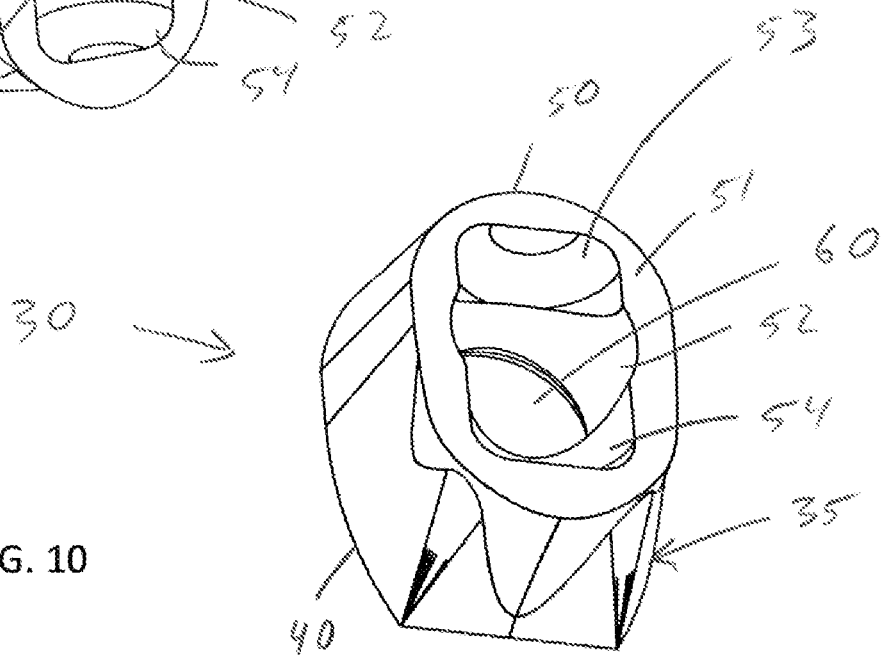
FIG. 10 is an alternative perspective view of the adapter illustrated in FIG. 8.

Turning now to FIGS. 8-10, it is seen that a preferred embodiment of an adapter 35 is provided. The adapter 35 has a first end 40 and a second end 50. The first end 40 has a front face 41 with two protrusions 42 and 43 extending therefrom. The front face 81 is sized and shaped (including perimeter dimensions, size and number of protrusions, etc.) to mate with a receiver 15. In this regard, the adapter used with the stock 25 is specific to the brand and model of the receiver and the adapter of the present invention is in no way limited to the specific geometry shown. The second end 50 has a rear face 51. The rear face has a cavity 52 formed therein. The cavity 52 as a top pocket 53 and a bottom pocket 54. The top and bottom pockets 54 and 54 are preferably round pockets. A passage 60, allowing the buffer tube to pass therethrough, extends from the front face 41 to the rear face 51. The passage 60 is between holes 42 and 43, respectively. The adapter can be made of a slightly compressible and flexible material such as rubber in an embodiment where it is desired to eliminate a gap between the stock and the adapter, discussed below.

Figure 11:
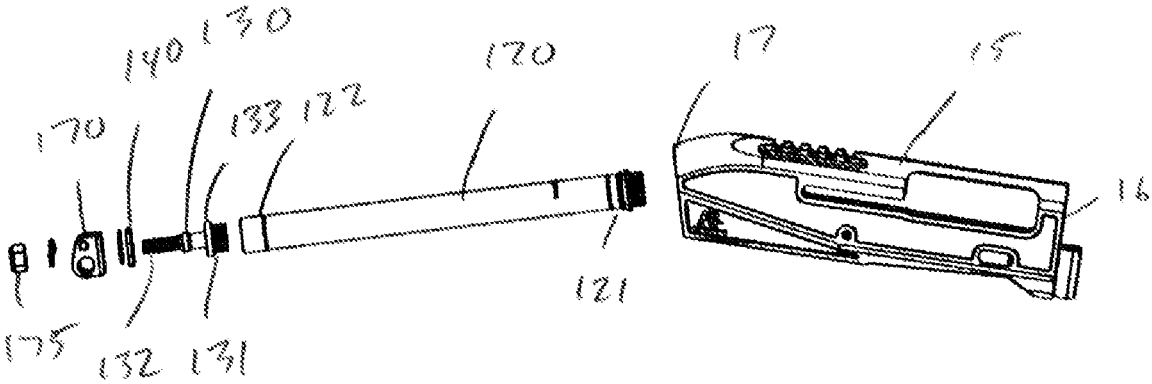
FIG. 11 is a partial exploded view showing alignment of a receiver, buffer tube, end cap, cast piece and bracket.
Figure 12:
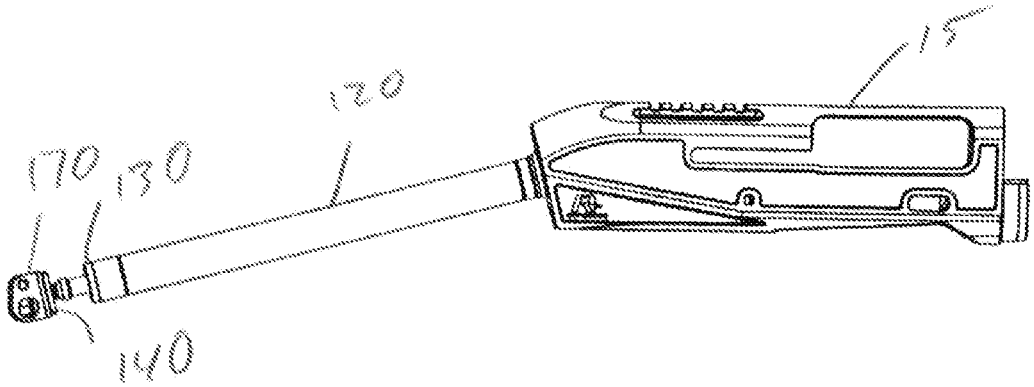
FIG. 12 is an assembled view of the components shown in FIG. 11.

Looking now to FIGS. 11 and 12 a preferred embodiment of a mount 120 of a firearm is illustrated. In this embodiment, a buffer tube 125 of a firearm is used with an end cap 130 for the mount. The orientation attachments of the buffer tube 125, end cap 130 and receiver 15 are illustrated in these two figures. The buffer tube 125 has a first end 126 and a second end 127. The first end 126 is externally threaded. The second end 127 is internally threaded. The first end 126 is preferably threaded into the receiver 15 to rigidly secure the buffer tube 125 to the receiver 15. An end cap 130 has a first end 131 and a second end 132. A seal 133, which extends in a plane perpendicular to an end cap longitudinal axis is between the ends 131 and 132. End 131 is externally threaded and projects forward of the seal 133. The end 131 threads into the rear end 127 of the buffer tube until the seal abuts the rear of the tube creating a sealed rear end. Threaded end 132 rearwardly extends from the seal 133 (and when the end cap 130 is attached to the buffer tube 125, the buffer tube).

Figure 13:
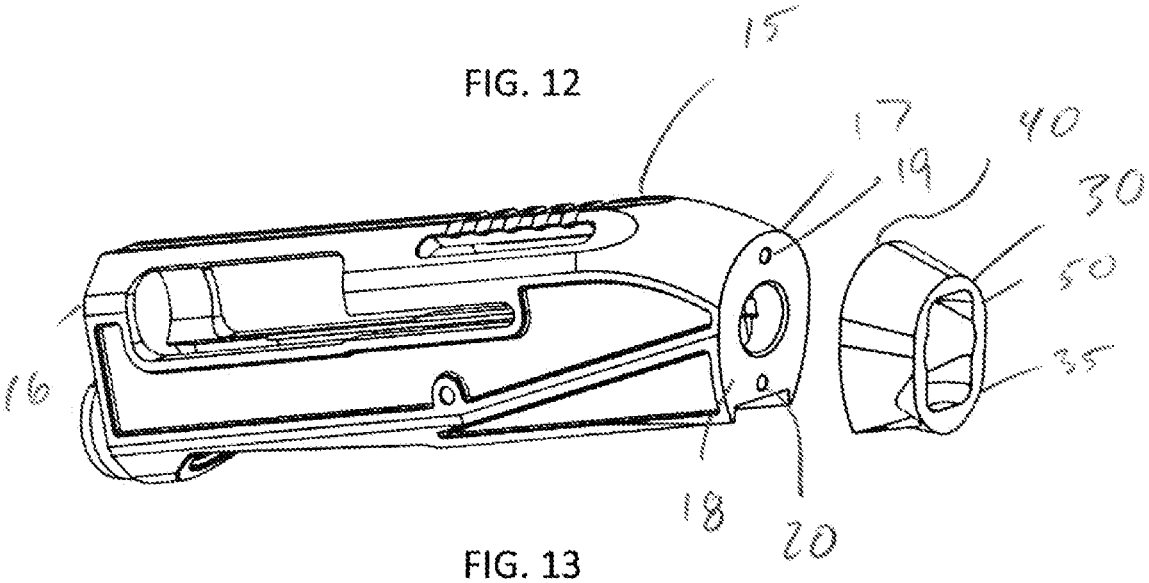
FIG. 13 is an exploded view showing a receiver adjacent an adapter.
Figure 14:
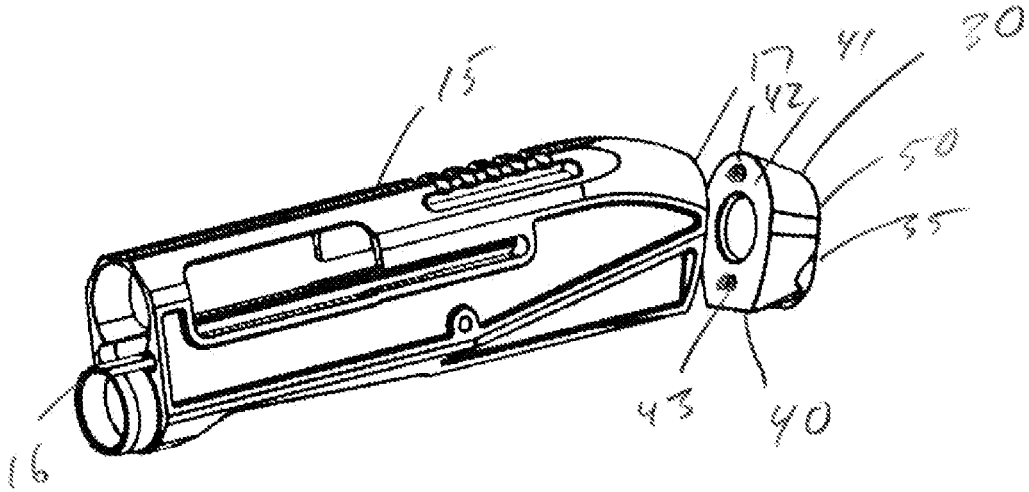
FIG. 14 is an alternative exploded view showing the receiver adjacent the adapter.

Orientation of the receiver 15 and adapter 35 is illustrated in FIGS. 13 and 14. The protrusions 42 and 43 extending from the front face 41 of the adapter 35 are aligned with the holes 19 and 20 and are received therein upon assembly. The front adapter front face 41 remains stationary relative to the receiver rear face 18 upon assembly.

Figure 15:
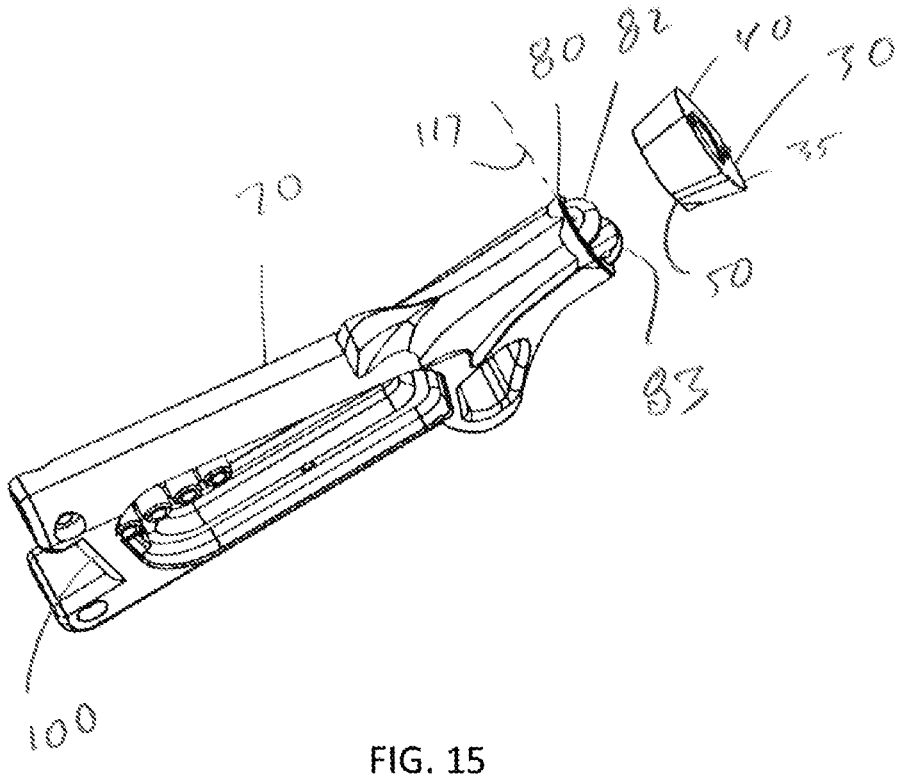
FIG. 15 is an exploded view showing the adapter adjacent the frame.
Figure 16:
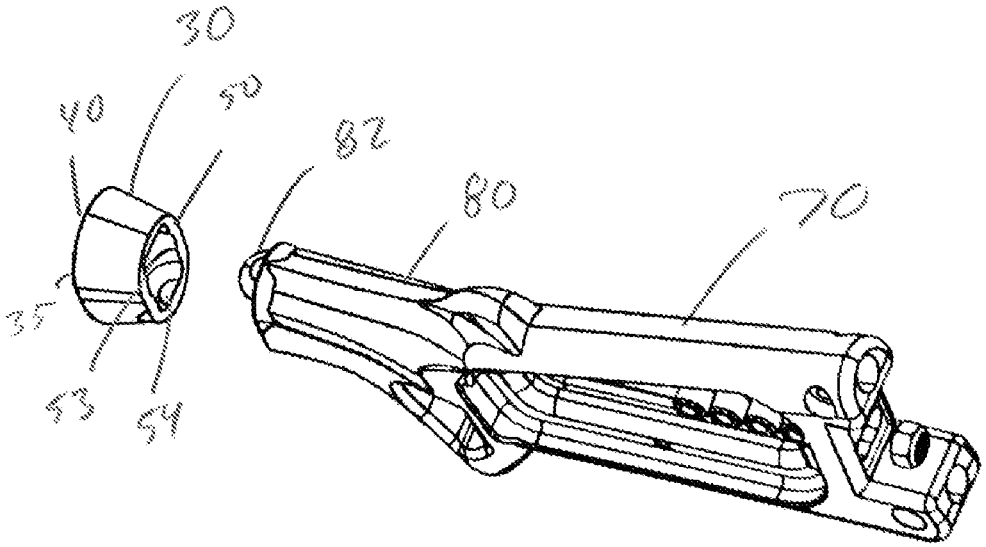
FIG. 16 is an exploded view showing the receiver adjacent the frame.

Orientation of the adapter 35 and frame 50 is illustrated in FIGS. 15 and 16. The tabs 82 and 83 extending forward of the frame 70 mate with the pockets 53 and 54 of the adapter 35 when the components are pressed together. This mating engagement prevents lateral movement between the two components when they are assembled. The frame 70 is rotatable relative to the adapter 35 about the pivot axis 117. The tabs 82 and 83 are fully received within and fully engage the pockets 53 and 54 (full radial contact) regardless of angular orientation between the adapter 35 and the frame 70 on account of cast. In the embodiment where the adapter 35 is slightly compressible, there is no gap between the adapter 35 and the frame 70 regardless of cast.

Figure 17:
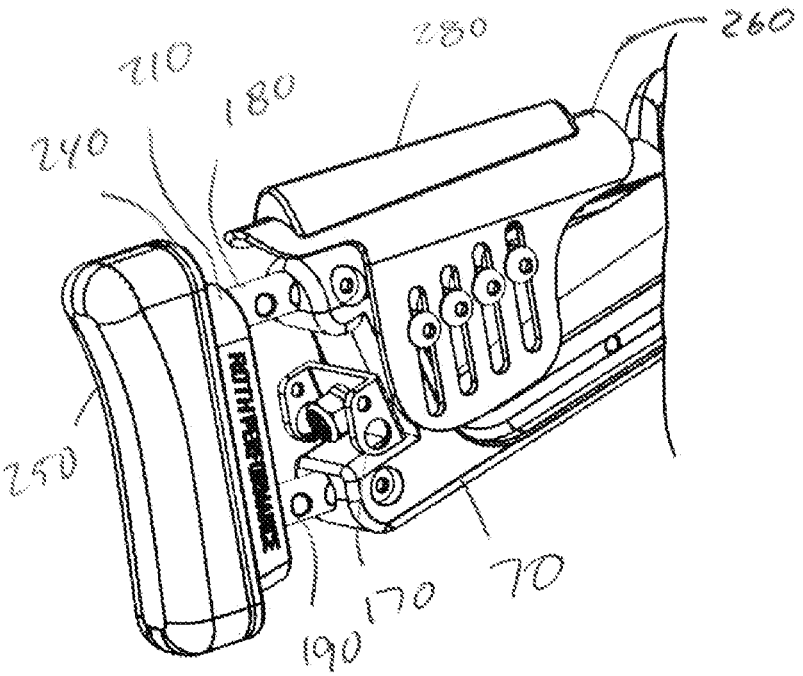
FIG. 17 is a perspective view showing the rear of the stock.
Figure 18:
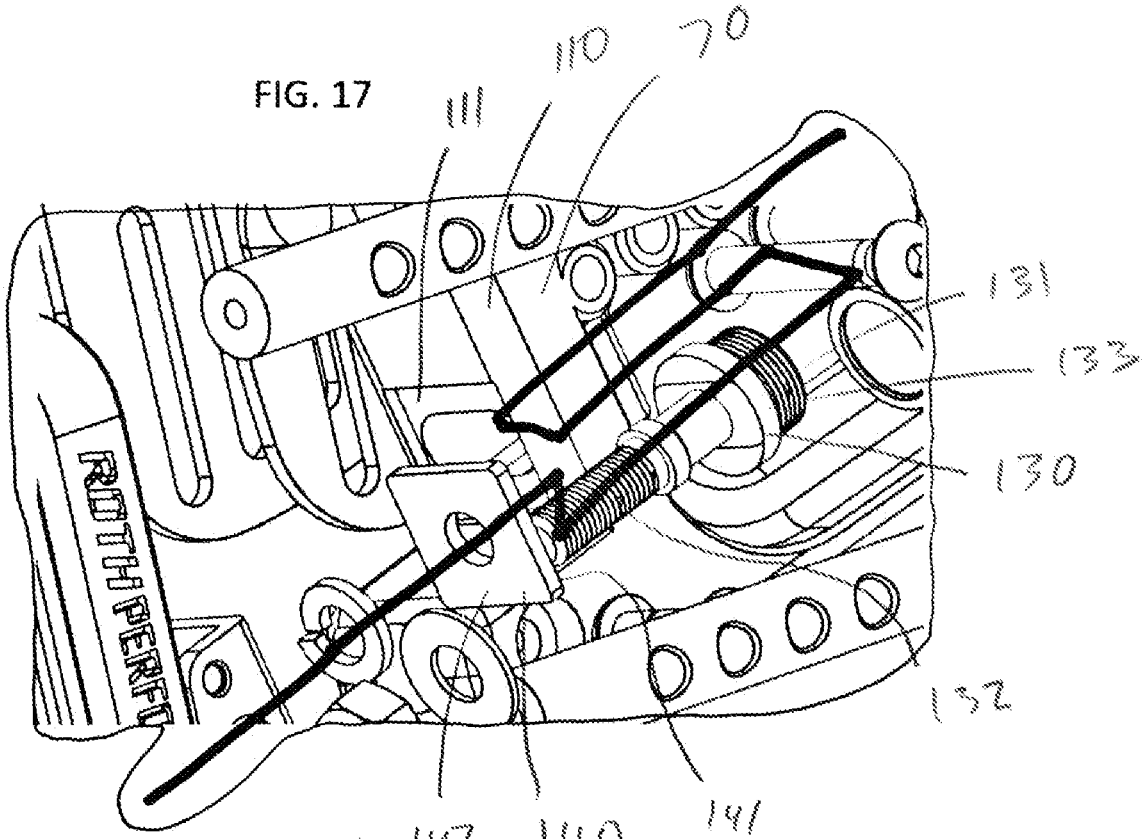
FIG. 18 is a partial exploded view of the rear of the stock.

A rear view of the stock is shown in FIG. 17. FIG. 18 is a partial exploded view of some components shown in FIG. 17. A nut 175 and a bracket 170 are shown. Looking at these figures, and also at FIGS. 11 and 12, it is seen that the nut twists onto the rearward end 132 of the end cap 170. This holds the bracket 170, cast piece 140, frame 70, adapter 35 and receiver 15 together.

Figure 19:
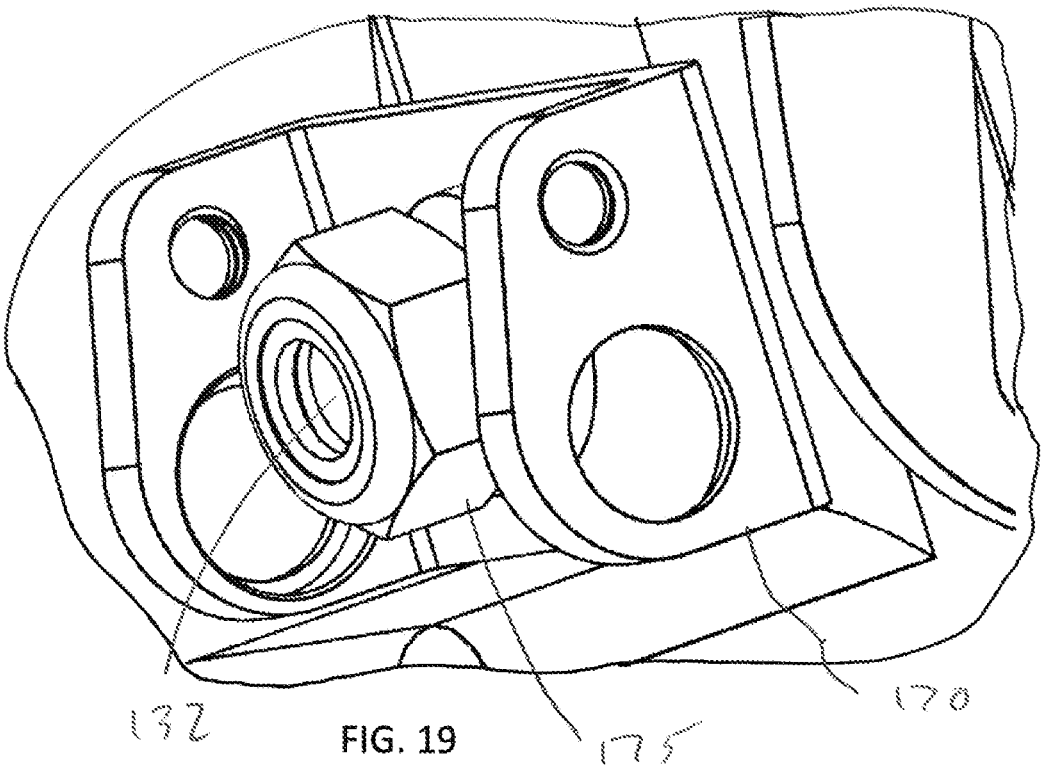
FIG. 19 is a partial close up view showing a nut and bracket at the rear of the frame.
Figure 20:
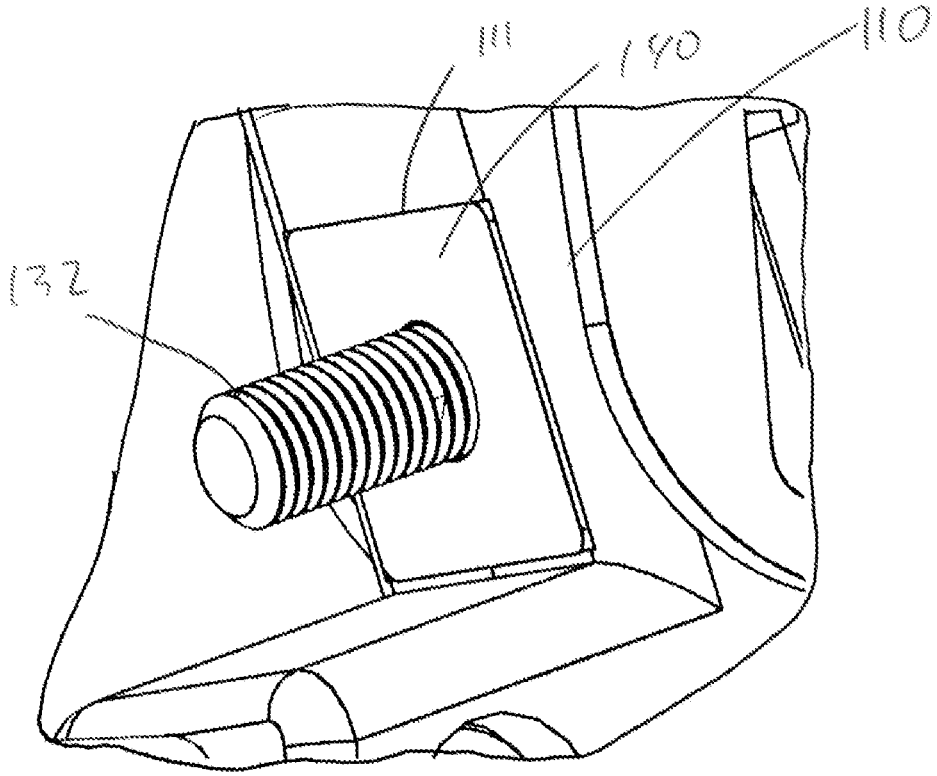
FIG. 20 is similar to FIG. 19, but shows the nut and bracket removed to illustrate the cast piece received with in a seat in the frame.
Figure 21:
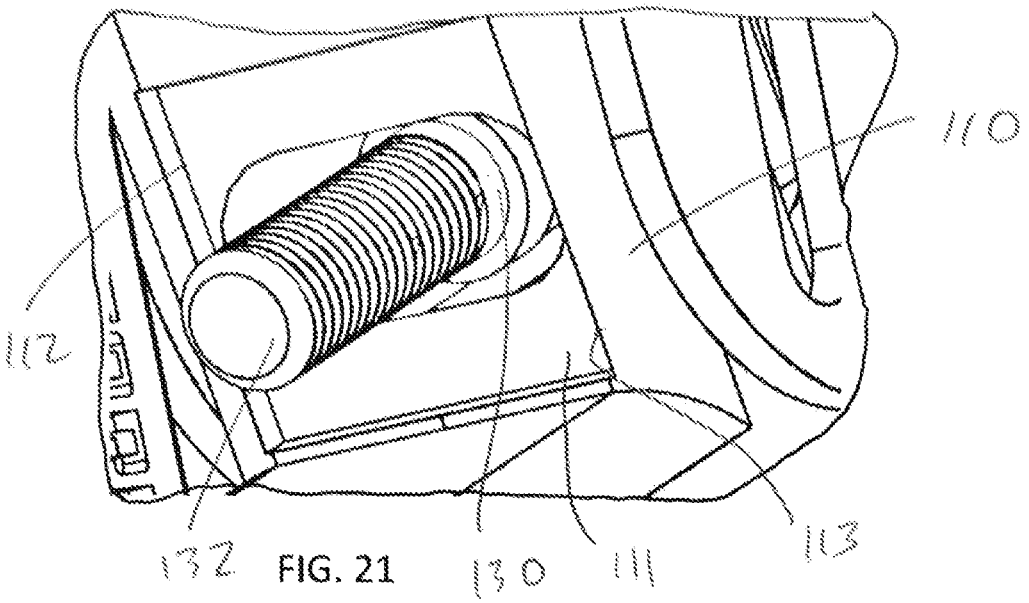
FIG. 21 is similar to FIG. 20, but shows the cast piece removed to illustrate the end cap extending through a slot in the seat.

The cast piece 140 sits within seat 111 of the frame when the stock 25 is assembled. The rear end 132 of the center cap 130 is shown in FIG. 21. The cast piece 140 is shown contained by seat 111 between sidewalls 112 and 113 in FIG. 20. The rear end 132 of the center cap 130 also passes through the cast hole 147. In this regard, it is appreciated that the cast hole 147 overlaps with the seat slot 114. The nut 175 is shown threaded onto the rear end 132 of the center cap 130 in FIG. 19 to hold the bracket (and hidden components) in place.

It is appreciated that while a cast piece 140 is shown to be seated in the seat 111 in the illustrated embodiment, that other structures can be provided to stationarily support the cast piece 140 with respect to the frame 70 without departing from the broad aspects of the present invention.

Figure 22:
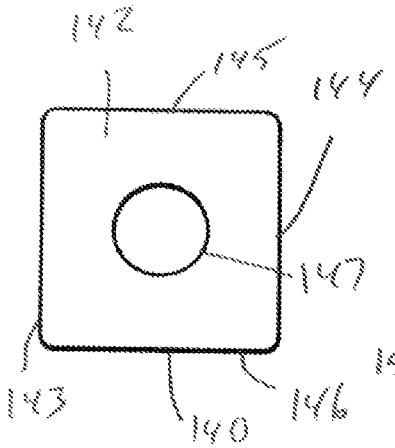
FIG. 22 is an end view of a cast piece with a centered cast hole.

The cast piece 140 is best seen in FIGS. 18 and 22. The cast piece 140 has a first face 141 and a second face 142. Cast piece 140 further has sides 143 and 144, a top 145 and a bottom 146. A hole 147 is between the sides 143 and 144. The hole 147 in cast piece 140 is preferably centrally aligned between the sides 143 and 144.

Cast pieces can also have offset cast holes.

Figure 23:
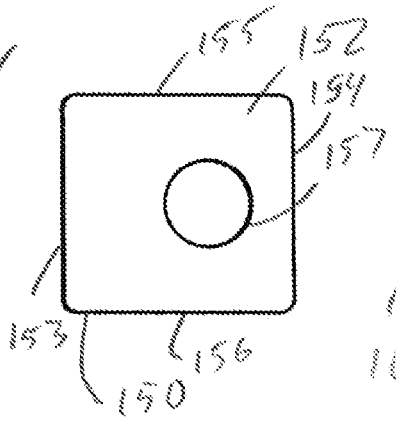
FIG. 23 is an end view of a cast piece with an offset cast hole.
Figure 25:
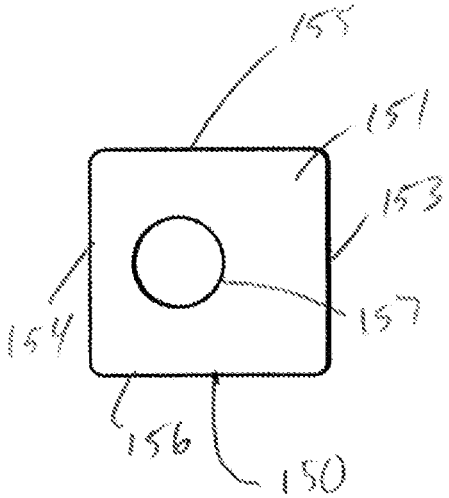
FIG. 25 is a reverse end view of the cast piece illustrated in FIG. 23.

One example is cast piece 150, which is shown in FIGS. 23 and 25. The cast piece 150 has a first face 151 and a second face 152. Face 151 is shown in FIG. 23 and face 152 is shown in FIG. 25. Cast piece 150 further has sides 153 and 154, a top 155 and a bottom 156. A hole 157 is between the sides 153 and 154. The hole 157 in cast piece 150 is preferably off center (not equidistantly aligned between the sides 153 and 144). Cast piece 150 can be selectably reversibly seated in seat 111 of the frame 70.

Figure 24:
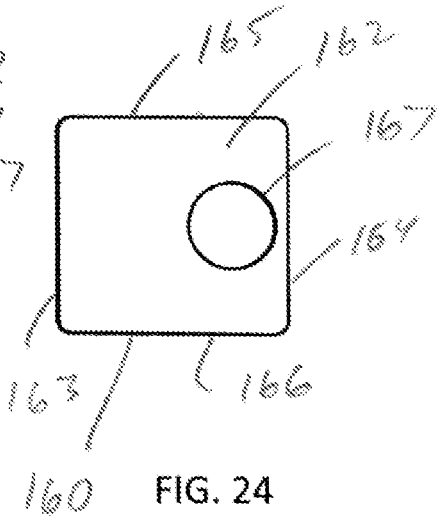
FIG. 24 is an end view of a cast piece with an offset cast hole.
Figure 26:
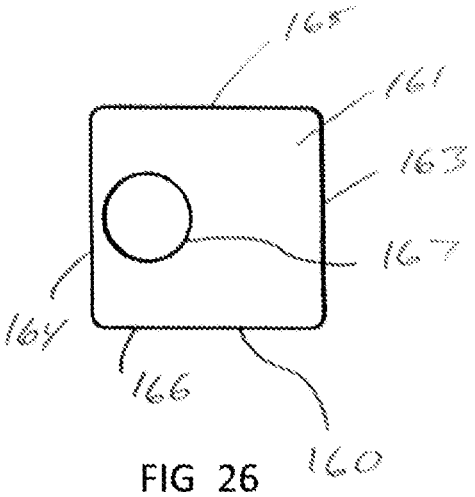
FIG. 26 is a reverse end view of the cast piece illustrated in FIG. 24.

Another example is cast piece 160, which is shown in FIGS. 24 and 26. The cast piece 160 has a first face 161 and a second face 162. Face 161 is shown in FIG. 24 and face 162 is shown in FIG. 26. Cast piece 160 further has sides 163 and 164, a top 165 and a bottom 166. A hole 167 is between the sides 163 and 164. The hole 167 in cast piece 160 is preferably located adjacent side 153. Cast piece 160 can be selectably reversibly seated in seat 111 of the frame 70.

Figure 27:
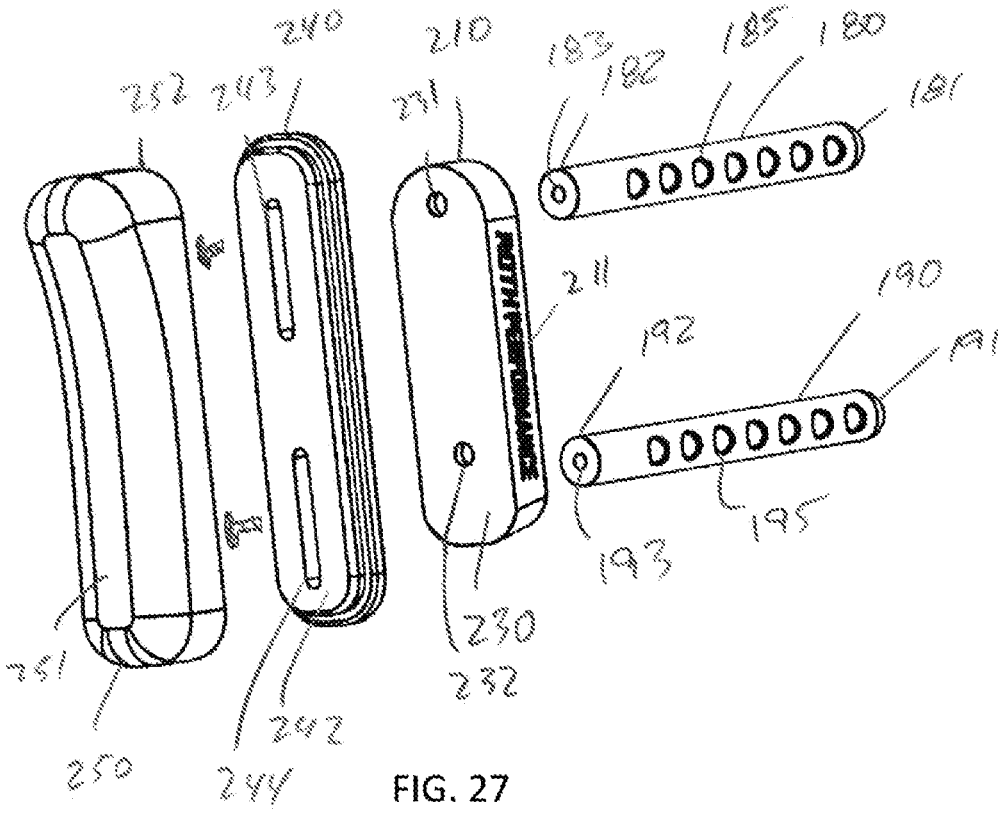
FIG. 27 is an exploded perspective view of the rods, the rod anchor, the butt plate and the butt pad.
Figure 28:
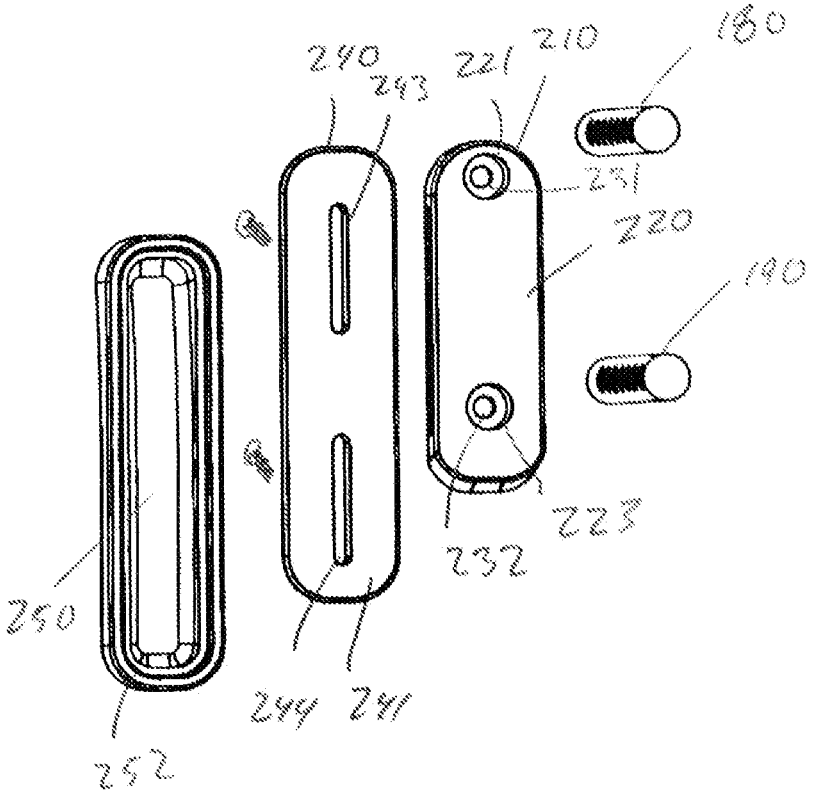
FIG. 28 is a reverse perspective view of the components illustrated in FIG. 27.

A rod 180 is illustrated in FIGS. 27 and 28. The rod 180 has ends 181 and 182. An end hole 183 is formed into the end 182 of the rod 180. Several cross holes 185 are through the rod 180. While seven holes are shown, it is appreciated that the rod can have more or fewer holes without departing from the broad aspects of the present invention. The holes 185 are in a preferred embodiment separated by a distance of ½ inch on center. The hole spacing could be greater or smaller without departing from the broad aspects of the present invention.

A second rod, rod 190, is also provided. The rod 190 has ends 191 and 192. An end hole 193 is formed into the end 192 of the rod 190. Several cross holes 195 are through the rod 190. While seven holes are shown, it is appreciated that the rod can have more or fewer holes without departing from the broad aspects of the present invention. The holes 195 are in a preferred embodiment separated by a distance of ½ inch on center. Rods 180 and 190 are preferably identical to each other. The hole spacing could be greater or smaller without departing from the broad aspects of the present invention.

Keeping with FIGS. 27 and 28, it is seen that an embodiment of a rod anchor 210 is provided. The rod anchor 210 has face 220 with two pockets 221 and 222 formed therein. The rod anchor 210 also has a rear face 230 with two holes 231 and 232. Hole 231 is preferably concentric with pocket 221. Hole 232 is preferably concentric with pocket 222.

Still keeping with FIGS. 27 and 28, it is seen that an embodiment of a butt plate 240 is illustrated. The butt plate 240 has opposed faces 241 and 242. Two vertically aligned slots 243 and 244, respectively, pass through the butt plate. A fastener, such as a screw with a head, can be inserted through the slot 243, through hole 231, and into end hole 183 of rod 180 to secure the rod 180 to the rod anchor 210. A fastener, such as a screw with a head, can be inserted through slot 244, through hole 232, and into end hole 193 of rod 190 so secure the rod 190 to the rod anchor 210.

Still keeping with FIGS. 27 and 28, it is seen that an embodiment of a butt pad 250 is provided. The butt pad 250 has a rear surface 251 and a rim 252. The rim is shaped to snap onto the periphery of the butt plate 240.

Figure 29:
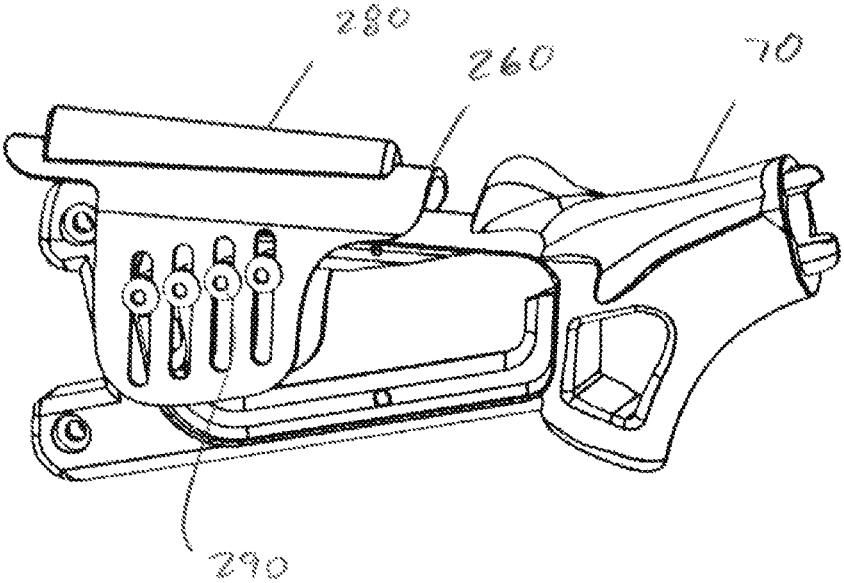
FIG. 29 is a partial perspective view showing an embodiment of the comb of the present invention.
Figure 30:
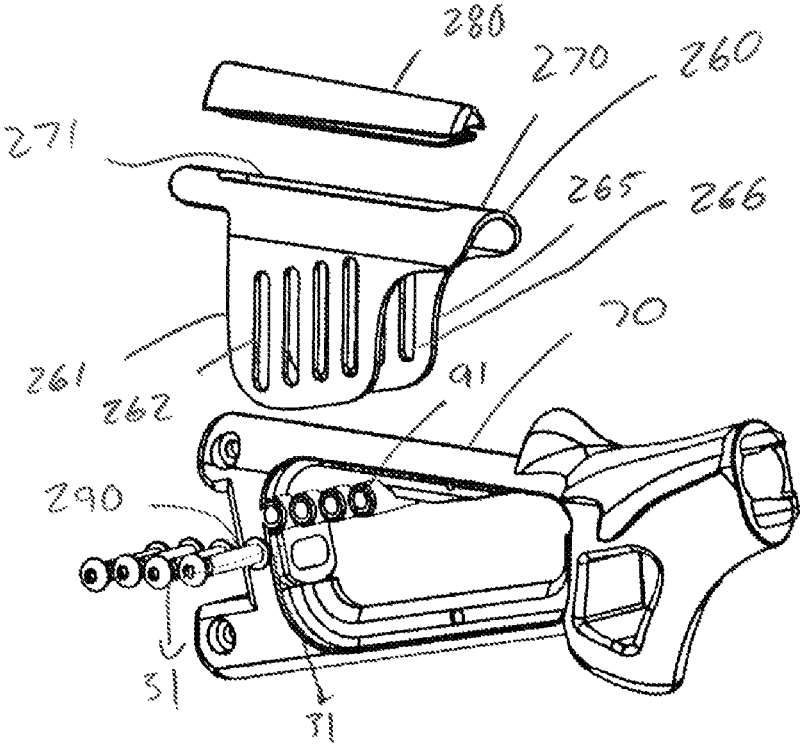
FIG. 30 is an exploded view of the cheek riser, the comb and the frame.
Figure 31:
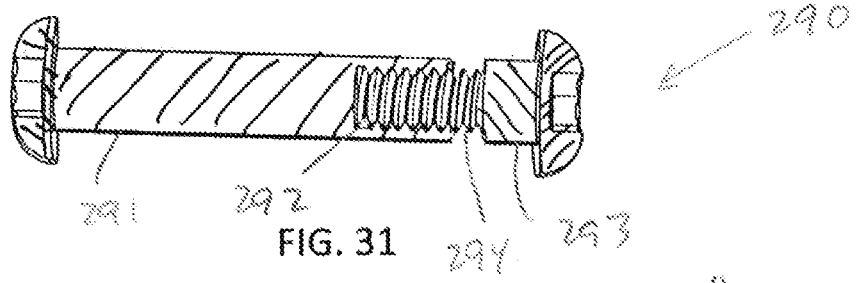
FIG. 31 is a cross-sectional view of a fastener.
Figure 32:
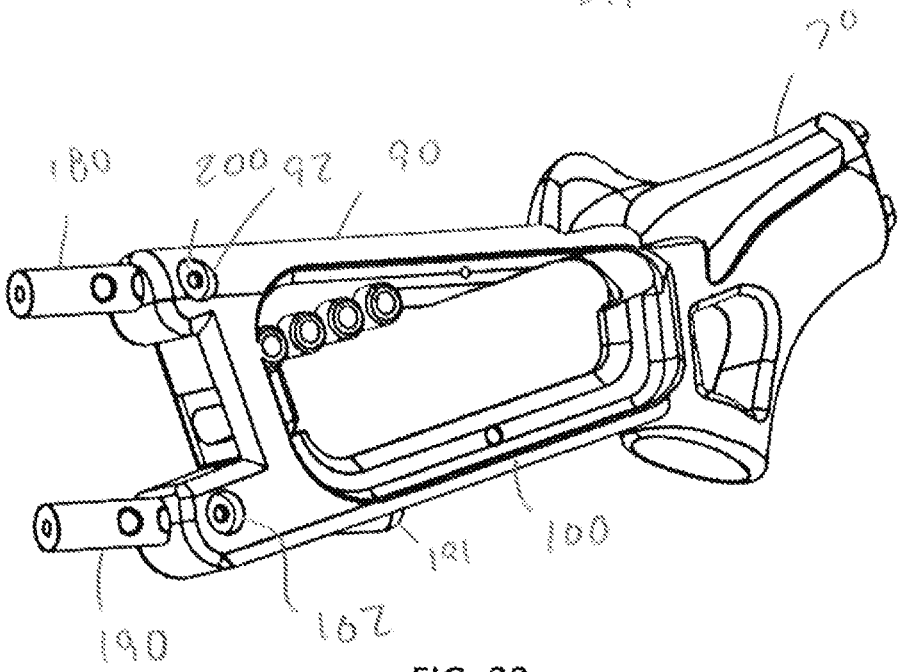
FIG. 32 is a perspective view of the frame and the rods.
Figure 33:
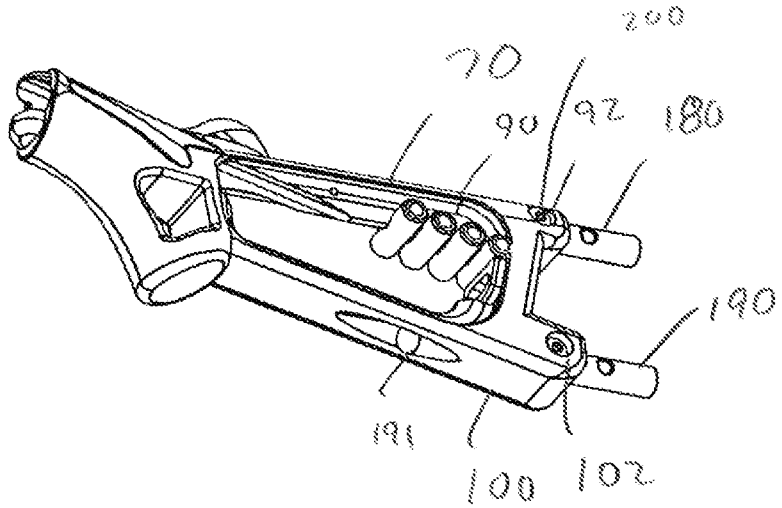
FIG. 33 is an alternative perspective view of the components illustrated in FIG. 32.

Now, turning to FIGS. 29-31, it is seen that embodiments of the comb 260, cheek riser 280 and fastener 290 are provided.

The comb 260 has a first side 261 with vertical slots 262 formed therethrough. The comb 260 also has a second side 265 with vertical slots 266 formed therethrough. Sides 261 and 265 are preferably parallel to each other. It is appreciated that while four slots are illustrated on each side, that more or fewer could be used without departing from the broad aspects of the present invention. The comb 260 has a top 270 with an opening 271 formed therethrough. A cheek riser 280 can be held within the opening 271.

A preferred embodiment of fastener 290 has a first piece 291 and a second piece 293. The first piece 293 has a threaded hole 292 and the second piece 293 has a threaded end 294. The threaded end 294 can be selectably turned into or out of the hole 292 to shorten or elongate (ultimately disassemble) the fastener 290. Fasteners 290 can be held in position within fastener passages 91 of the frame. The fastener has heads with diameters larger than comb slot widths such that they do not pass through the slots 262 and 266.

Figure 34:
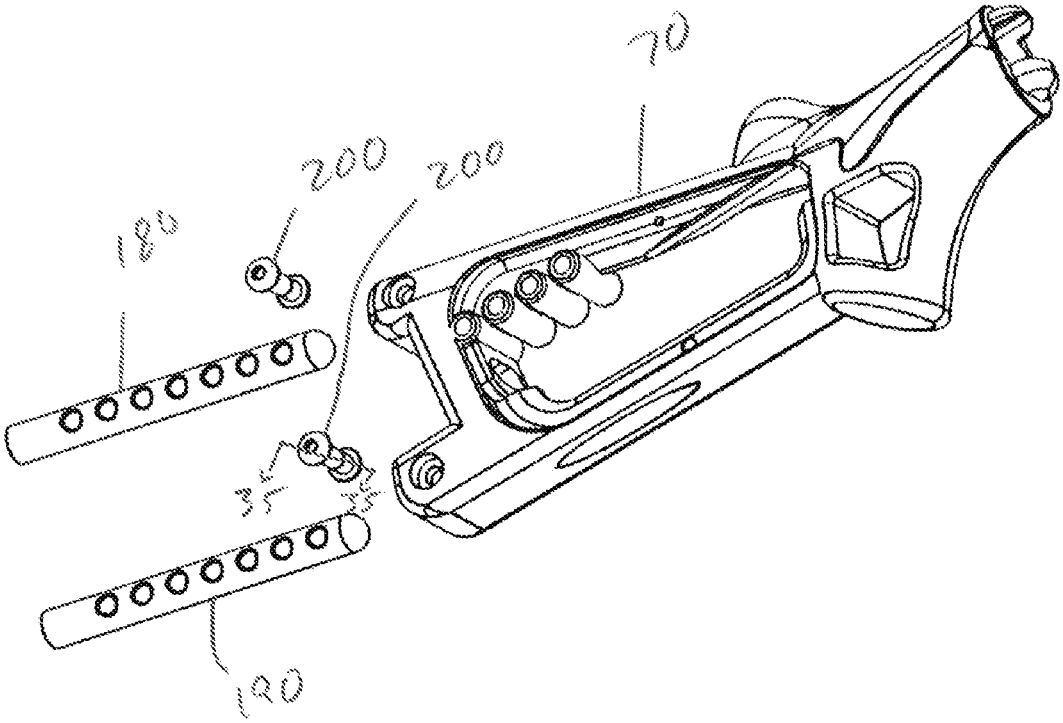
FIG. 34 is an exploded view of the components illustrated in FIG. 32.
Figure 35:
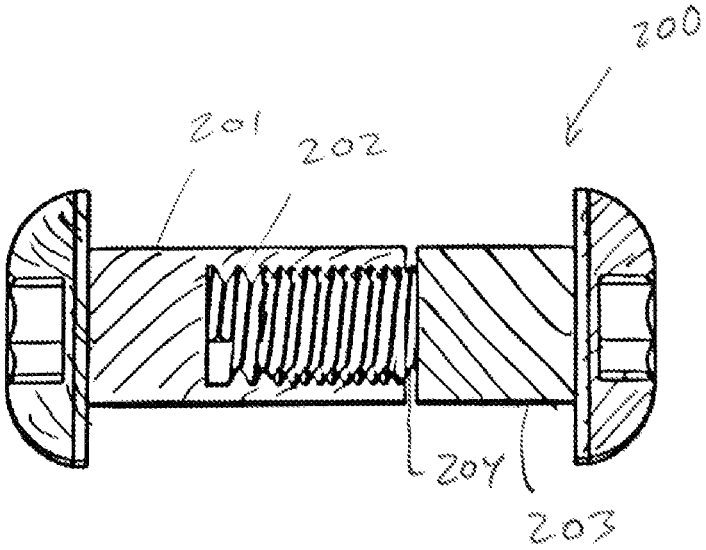
FIG. 35 is a cross-sectional view of a peg.

A preferred embodiment of a peg 200 is illustrated in FIGS. 34 and 35. The peg 200 has a first piece 201 and a second piece 203. The first piece 201 has a threaded hole 202 and the second piece 203 has a threaded end 204. The threaded end 204 can be selectably turned into or out of the hole 202 to shorten or elongate (ultimately disassemble) the peg 200. Pegs 200 can be held in position within the peg holes 92 and 102 of the frame 70.

The front end 181 of rod 180 is received within rod passage 93 of the frame 70 and locked in place with a peg 200. The front end 191 of rod 190 is received within rod passage 103 of the frame 70 and locked in position with a peg 200.

Figure 36:
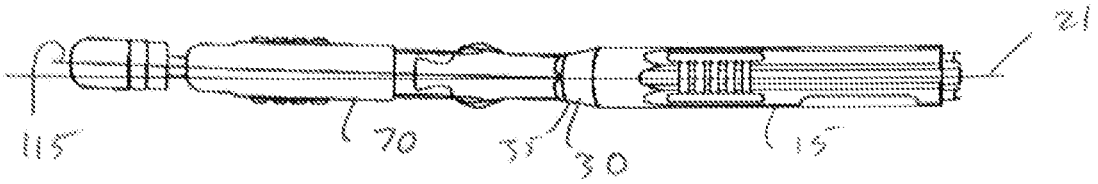
FIG. 36 is a top view illustrating left max cast.
Figure 37:
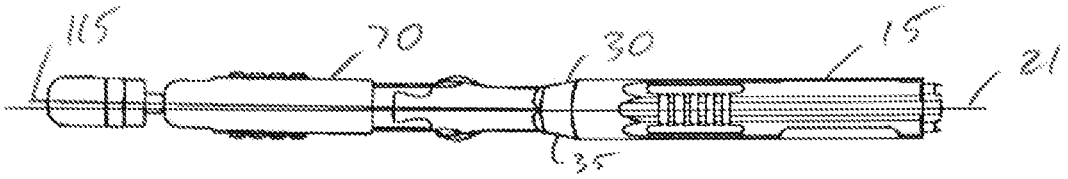
FIG. 37 is a top view illustrating left mid cast.
Figure 38:
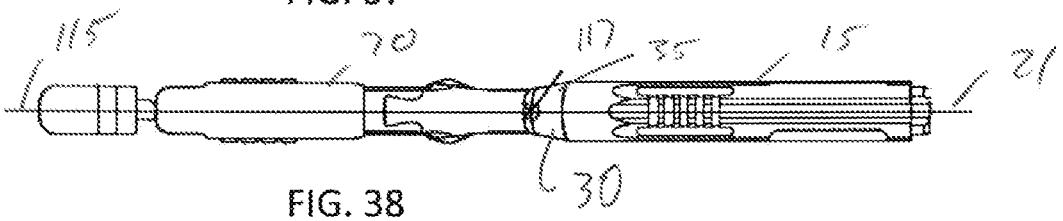
FIG. 38 is a top view illustrating neutral cast.
Figure 39:
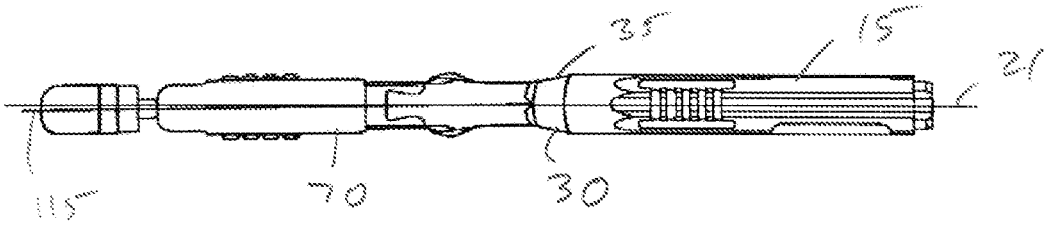
FIG. 39 is a top view illustrating right mid cast.
Figure 40:
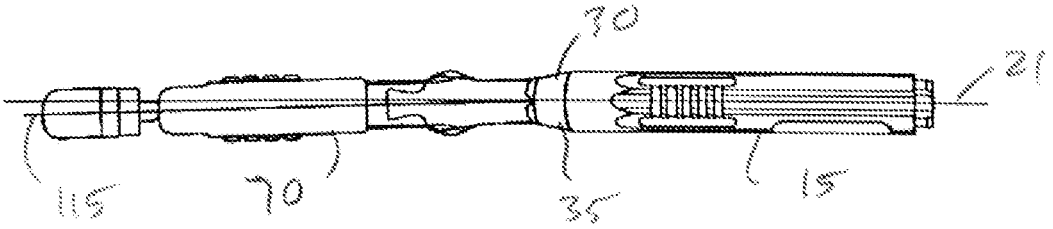
FIG. 40 is a top view illustrating right max cast.

Adjustment of cast is illustrated in FIGS. 36-40. It is appreciated that the adapter can be slightly compressible to prevent a gap from forming between the adapter 35 and the frame 70 when angular cast adjustments are made. In FIG. 36, the frame 70 is cast left approximately 1.5 degrees about the pivot axis 117. This is accomplished when cast piece 160 is used and face 161 is positioned away from the seat 111. In FIG. 37, the frame 70 is cast left approximately 0.75 degrees about the pivot axis 117. This is accomplished when cast piece 150 is used and face 151 is positioned away from the seat 111. In FIG. 38, there is no cast about the pivot axis 117. This is accomplished when cast piece 140 is used. In FIG. 39, the frame 70 is cast right approximately 0.75 degrees about the pivot axis 117. This is accomplished when cast piece 150 is used and face 152 is positioned away from the seat 111. In FIG. 40, the frame 70 is cast right approximately 1.5 degrees about the pivot axis 117. This is accomplished when cast piece 160 is used and face 162 is positioned away from the seat 111. It is appreciated that different cast amounts could be used without departing from the broad aspects of the present invention. Specifically, the slot could be wider if larger angular adjustability is desired and used with cast pieces with greater amounts of hole offsets. Further, the hole offsets can be made to any desired distance to achieve a desired cast amount.

Figure 41:
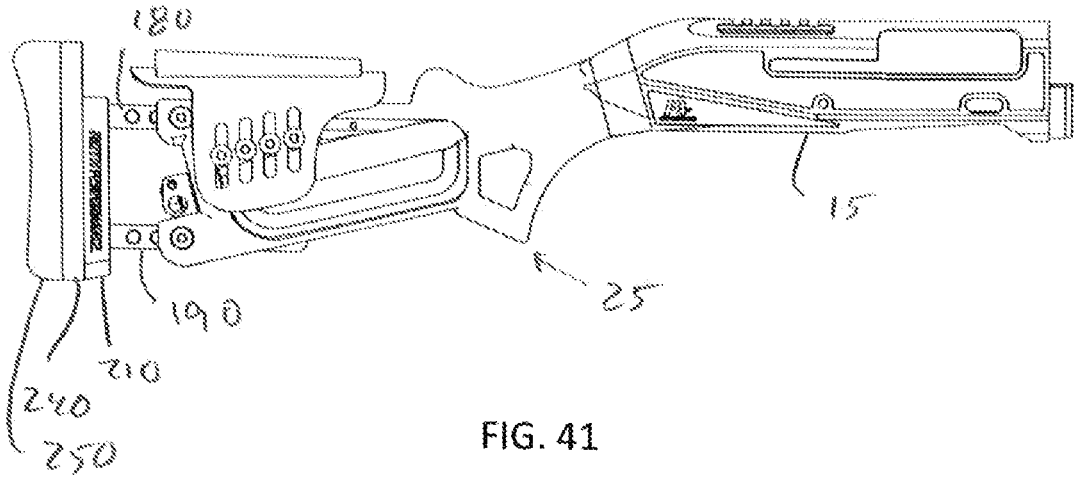
FIG. 41 is a side view showing the butt plate and butt pad adjusted to the highest setting.
Figure 42:
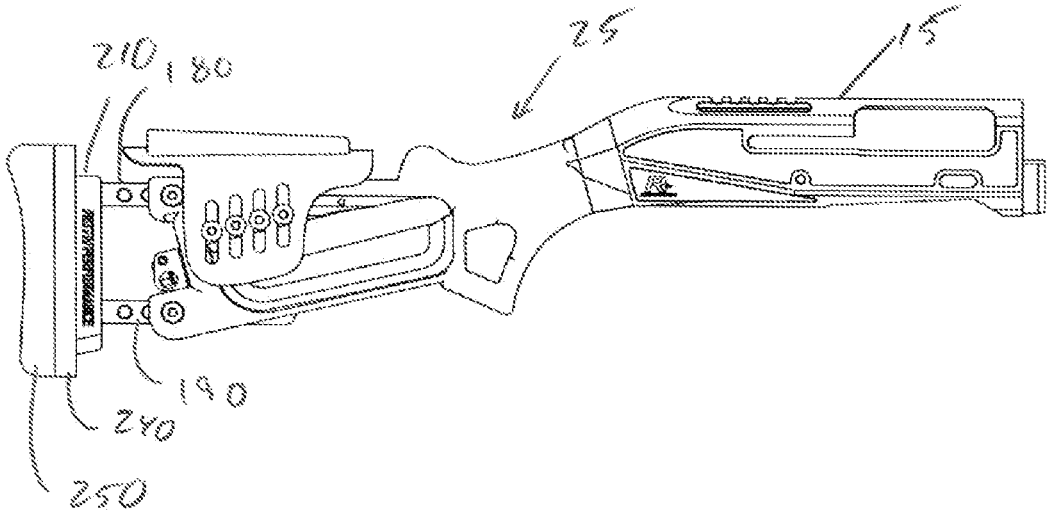
FIG. 42 is a side view showing the butt plate and butt pad adjusted to the midpoint setting.
Figure 43:
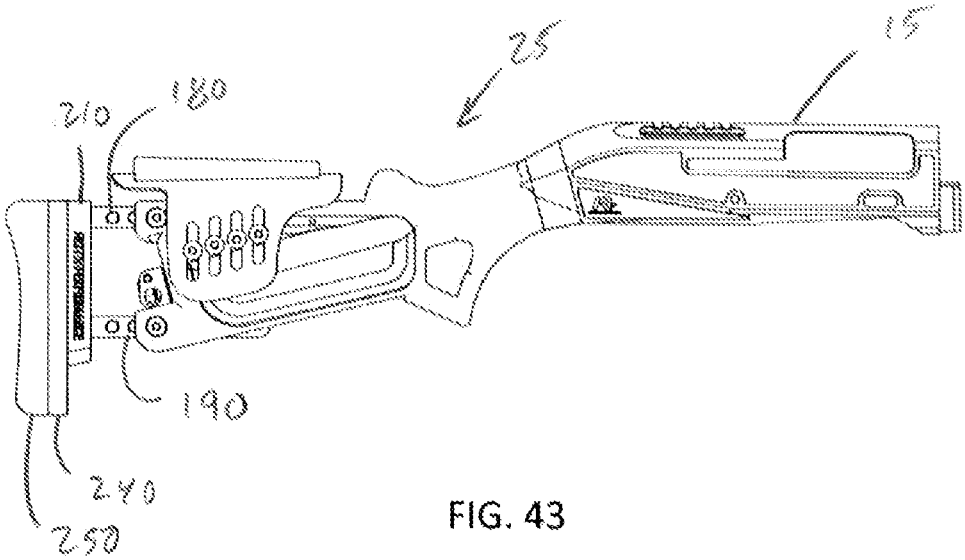
FIG. 43 is a side view showing the butt plate and butt pad adjusted to the lowest setting.

Vertical adjustment of the butt plate 240 and butt pad 250 are shown in FIGS. 41-43. The butt plate 240 is at the highest position in FIG. 41. This is accomplished by having fasteners pass through the top of slots 243 and 244 in the butt plate 240. The butt plate 240 is at an intermediate position in FIG. 42. This is accomplished by having fasteners be pass through the slots 243 and 244 in the butt plate 240 at locations between the slot tops and bottoms. The butt plate 240 is at the lowest position in FIG. 43. This is accomplished by having fasteners pass through the bottom of slots 243 and 244 in the butt plate 240.

Figure 44:
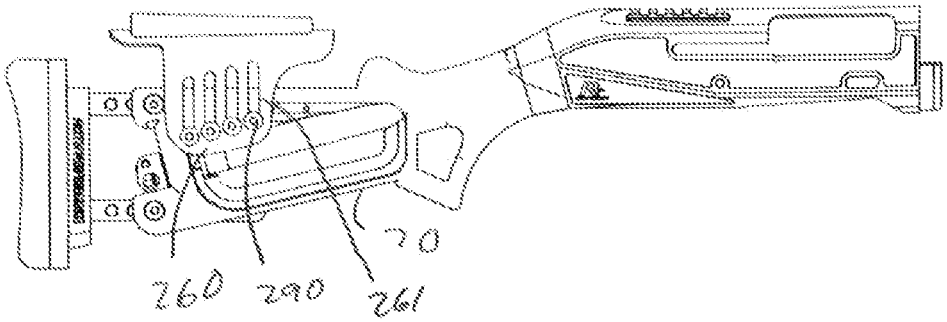
FIG. 44 is a side view showing the comb and cheek riser extended to a full height setting.
Figure 45:
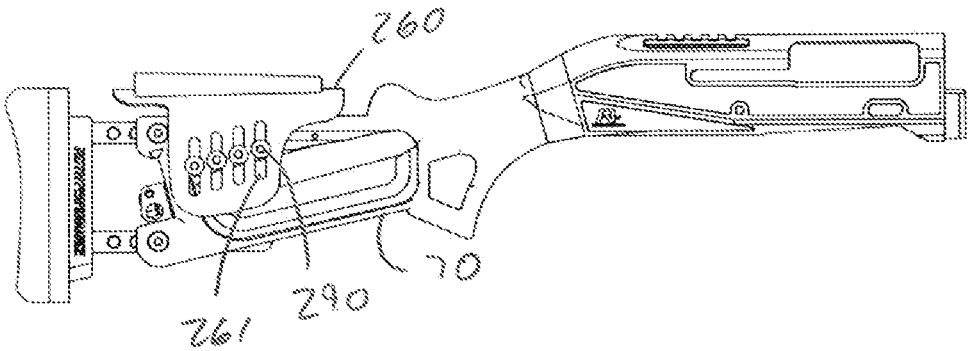
FIG. 45 is a side view showing the comb and cheek riser extended to a midpoint height setting.
Figure 46:
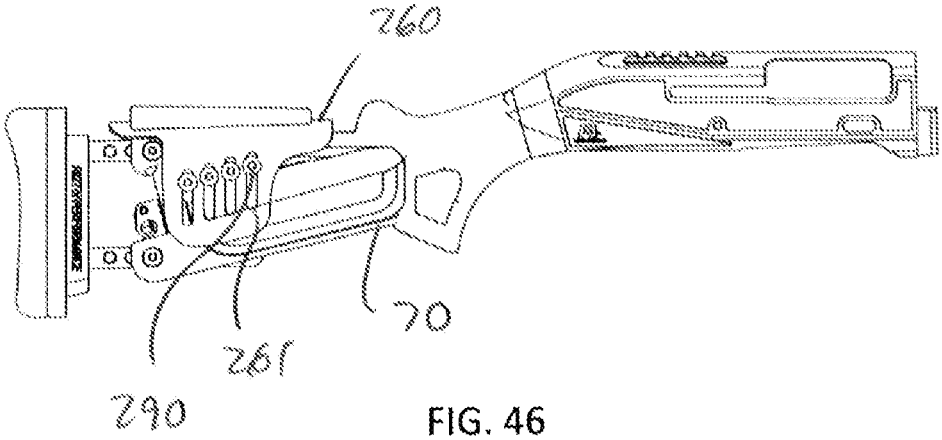
FIG. 46 is a side view showing the comb and cheek riser extended to a low height setting.

Vertical adjustment of the comb 260 is illustrated in FIGS. 44-46. The comb 260 is shown in the highest position in FIG. 44. This is accomplished when fasteners 290 are tightened at the bottom of the slots 262 and 266. The comb 260 is shown in an intermediate position in FIG. 45. This is accomplished when fasteners 290 are tightened in intermediate positions relative to the slots 262 and 266. The comb 260 is shown in the lowest position in FIG. 46. This is accomplished when fasteners 290 are tightened at the top of the slots 262 and 266.

Figure 47:
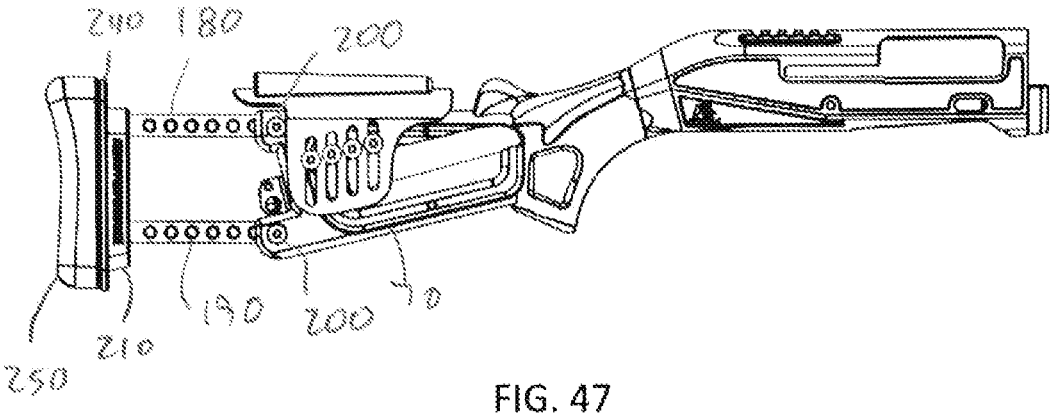
FIG. 47 is a side view showing the stock stet to a maximum length of pull.
Figure 48:
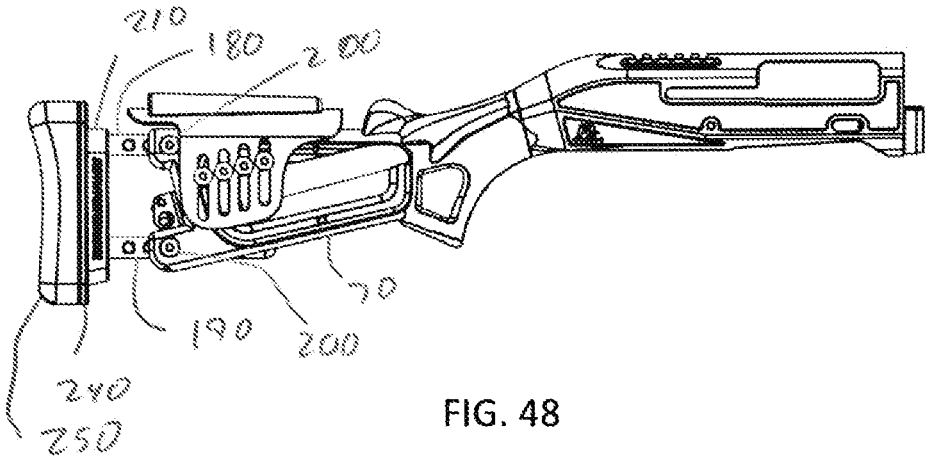
FIG. 48 is a side view showing the stock set to an intermediate length of pull.
Figure 49:
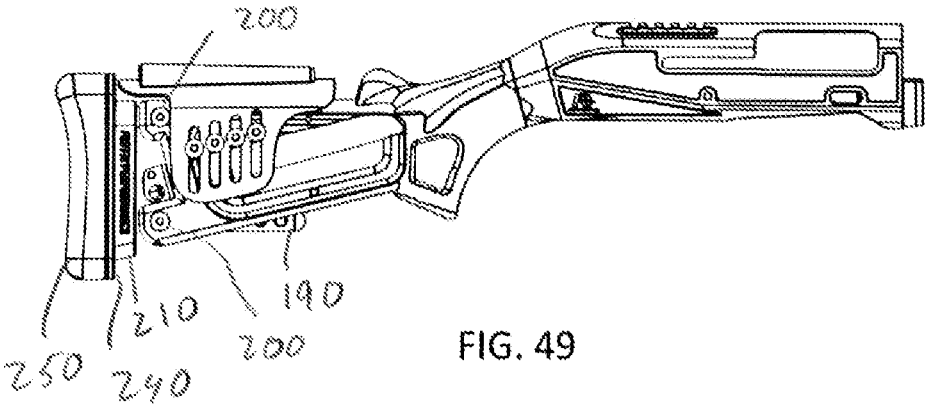
FIG. 49 is a side view showing the stock set to a minimum length of pull.
Figure 50:
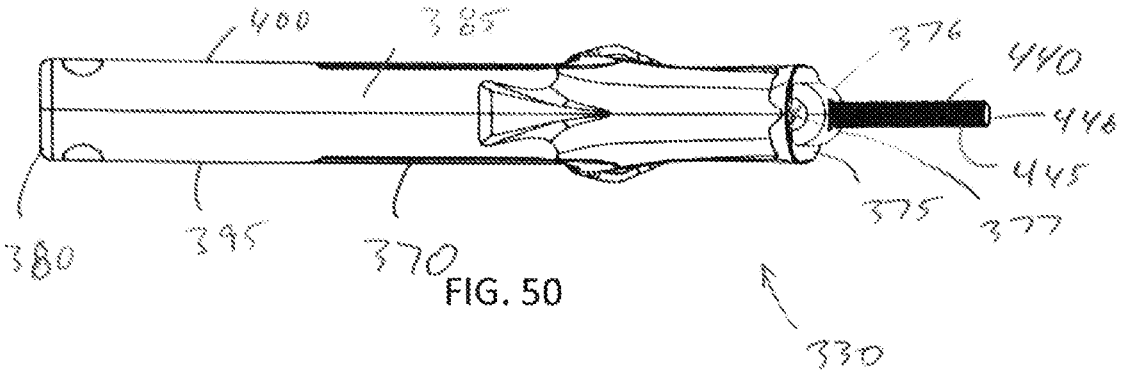
FIG. 50 is a top view showing an alternative embodiment of a frame and mount.
Figure 51:
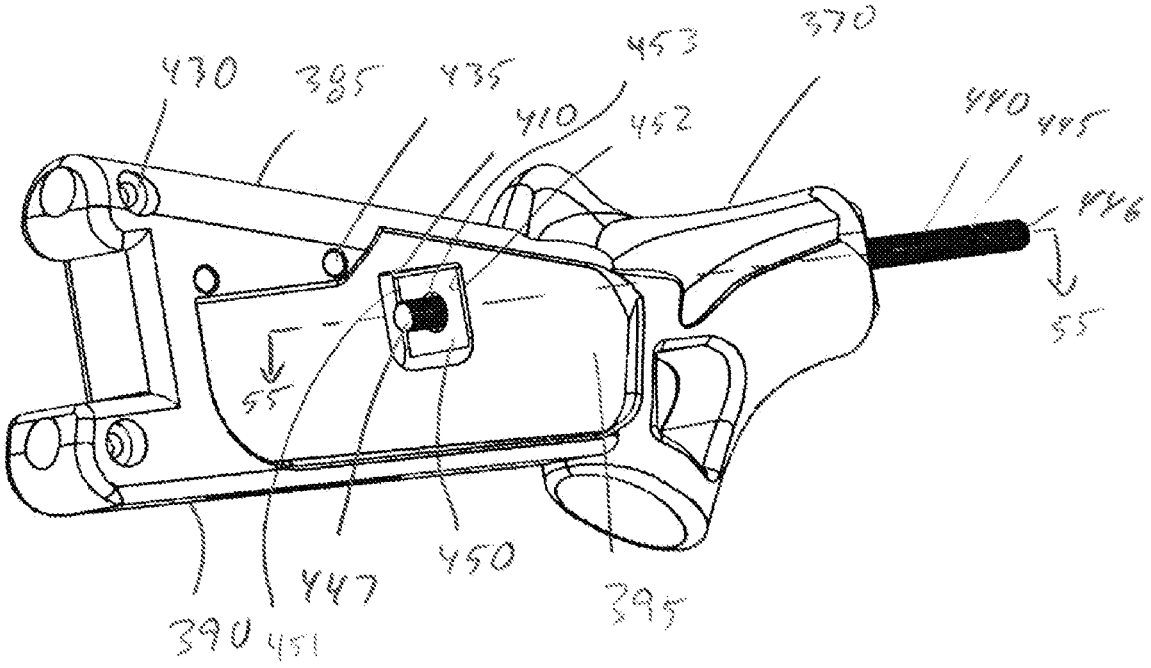
FIG. 51 is a rear perspective view of the embodiment illustrated in FIG. 50.
Figure 52:
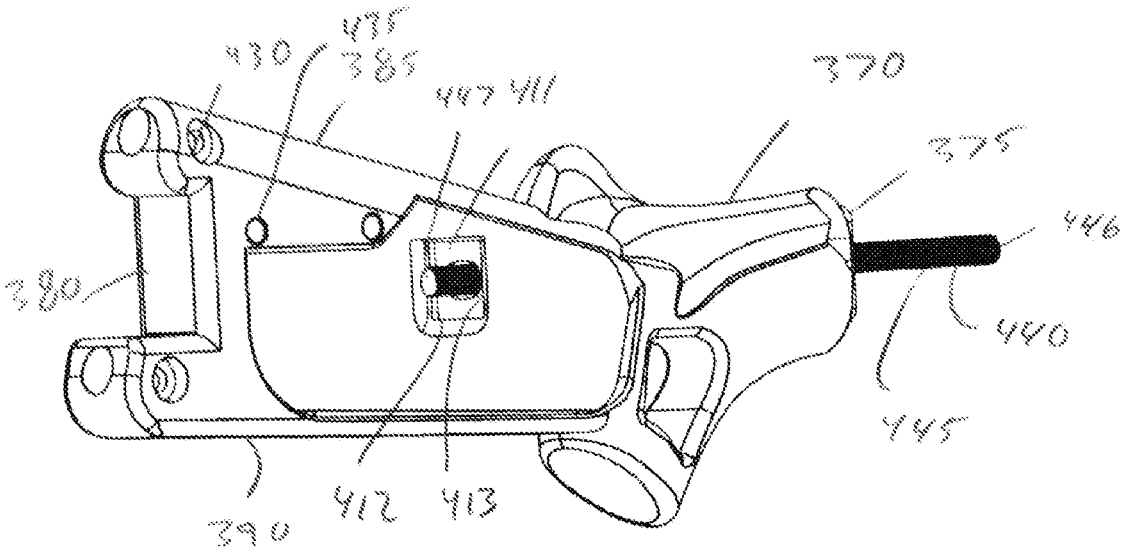
FIG. 52 is similar to FIG. 51 but is illustrated with the cast piece removed.
Figure 53:
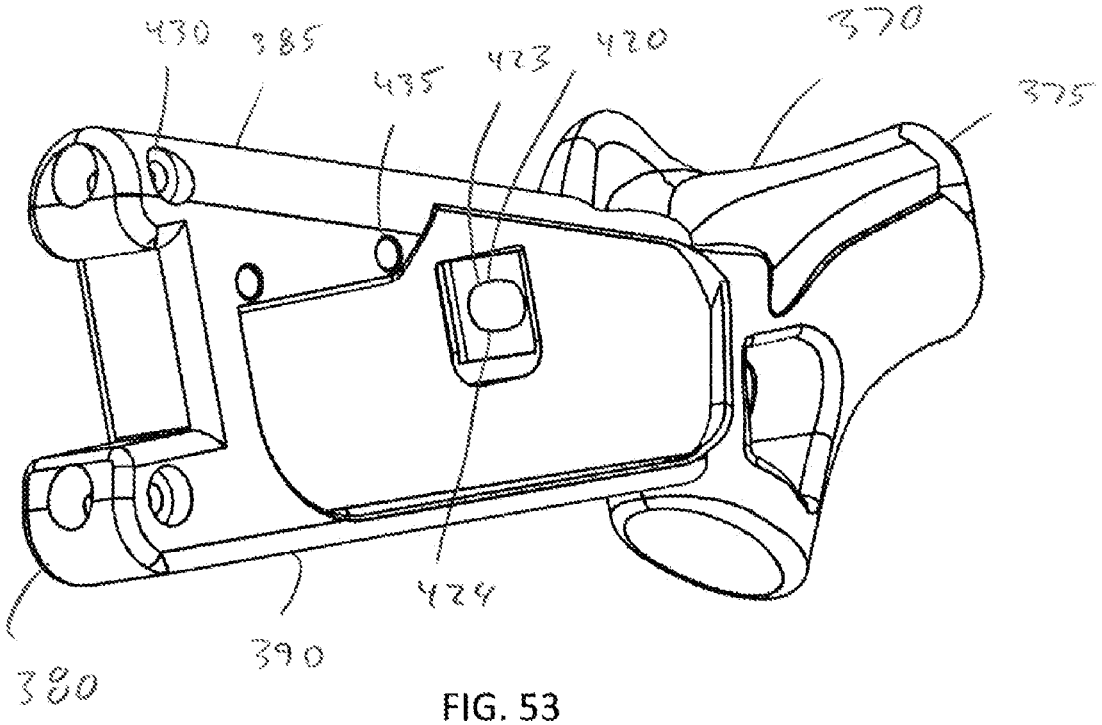
FIG. 53 is similar to FIG. 52 but is illustrated with the mount also removed.
Figure 54:
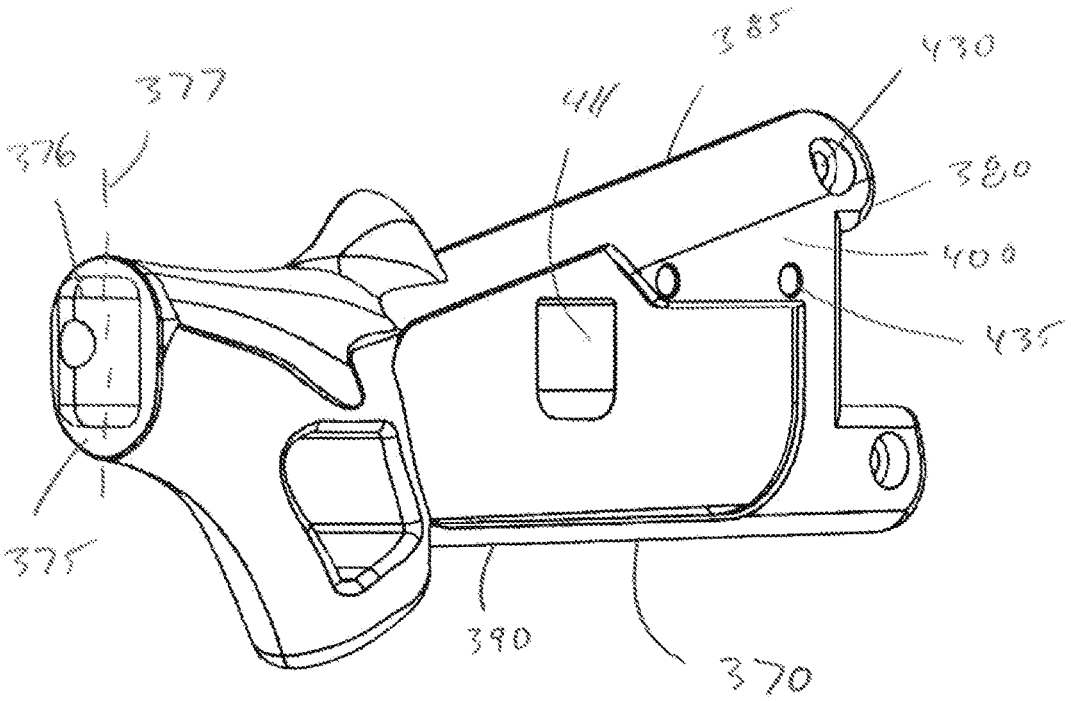
FIG. 54 is a front perspective view of the embodiment illustrated in FIG. 54.
Figure 55:
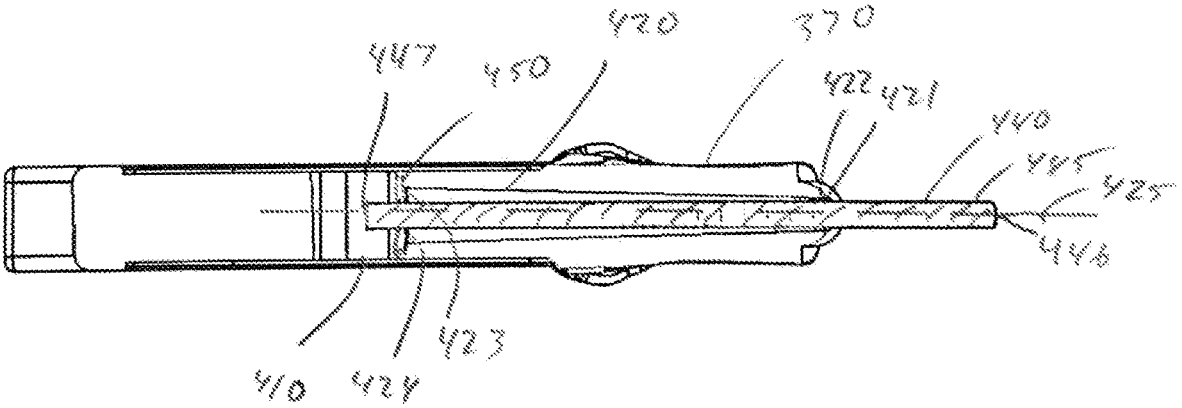
FIG. 55 is a cross-sectional view taken along line 55-55 in FIG. 51.
Figure 56:
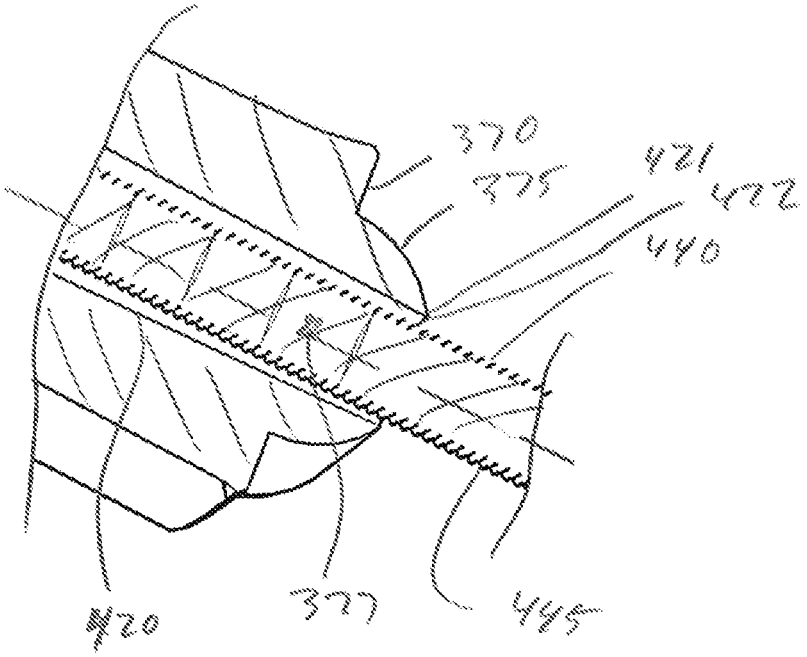
FIG. 56 is a close-up perspective cross-sectional view of a first end of a mount passage of the frame as illustrated in FIG. 55.
Figure 57:
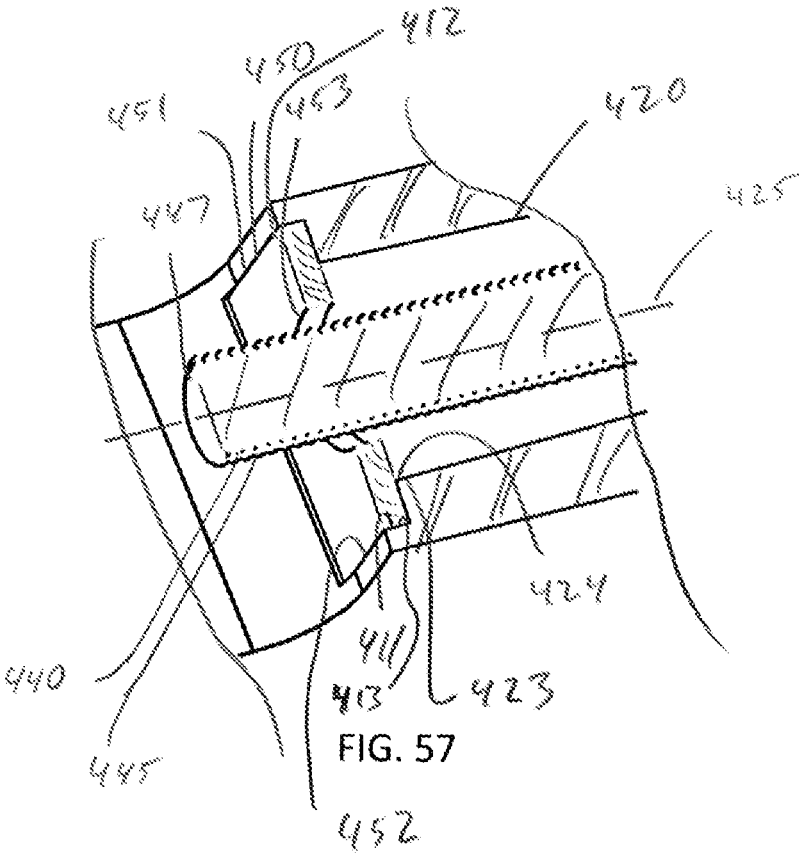
FIG. 57 is a close-up perspective cross-sectional view of a second end of a mount passage of the frame as illustrated in FIG. 55.

Longitudinal length of pull adjustments are illustrated in FIGS. 47-49. The length of pull is the longest in FIG. 47, is intermediate in FIG. 48, and is shortest in FIG. 49. Pegs 200 are used to lock the rods 180 and 190 in selected positions within rod passages 93 and 103, respectively. It is appreciated that while rods with seven holes will allow the user to select from seven different lengths of pull. More or fewer holes, different spacing and different rod lengths would allow for different amounts of adjustment.

Turning now to FIGS. 50-57, it is seen that an alternative embodiment of a frame 370 and mount 440 (of the firearm) of a cast system 330 are illustrated. An adapter similar to the adapter described above is used to mate to the rear face of a receiver.

The frame 370 has a front 375 with a face 376. The front face 376 has a rounded portion. The geometric center of the rounded portion defines a pivot axis 377 (pivot between frame 370 and an adapter. The frame 370 also has a rear 380, a top 385, a bottom 390, a first side 395 and an opposed second side 400. There is a central opening 410 open to sides 395 and 400, and surrounded by the front 375, rear 380, top 385 and bottom 390. The central opening 410 has a front, a rear, a top and a bottom. The front of the opening 410 has a seat 411. The seat 411 has sidewalls 412 and 413, respectively. A mount passage 420 passes through the front 375 of the frame 370. The passage 420 has an end 421 with an opening 422 open through the center of the front face 376 of the front 370, preferably equally spaced between sides 395 and 400 of the frame 370. The mount passage 420 also has a second end 423 open with a slot 424 to the seat 411. The passage 420 has a centerline 425 along the longitudinal axis of the passage. The passage is preferably a tapered passage, with an increasing width dimension from end to end. Peg holes 430 and comb support passages 435 are also provided.

An embodiment of mount 440 of a firearm is a rod 445 threaded at ends 446 and 447. A cast piece 450, having sides 451 and 452 with a cast hole 453 therebetween is also illustrated. It is appreciated that while a central hole 453 is illustrated (for an embodiment without cast), that cast pieces similar to or the same as the cast pieces described above could be used to provide cast to the frame 370 relative to the mount 440 about pivot axis 377.

Thus, it is apparent that there has been provided, in accordance with the invention, a universally adjustable firearm stock that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A stock for a firearm with a receiver with a center line and a receiver rear face, the firearm further having a mount with a rear, said stock comprising:

a frame having a front riser;

an adapter with an adapter front face and an adapter rear face, said adapter front face having a profile corresponding to the receiver rear face, said adapter rear face mating with said front riser, said frame being selectively rotatable relative to said adapter;

a cast piece with a cast piece hole, said cast piece being stationarily supported by said frame, the rear of the mount passing through said cast piece hole, the location of said cast piece hole with respect to the center line determines an amount of cast of said frame.

2. The stock of claim 1 wherein:

said adapter rear face has a cavity, a first pocket and a second pocket; and said front riser has a first tab and a second tab, said first tab being received in said first pocket and said second tab being received in said second pocket.

3. The stock of claim 1 wherein:

said frame further has a rear riser, said rear riser having a slot therethrough; and said cast piece is stationarily supported by said rear riser, said cast piece hole being selectably aligned with said slot.

4. The stock of claim 3 wherein:

said rear riser has a seat with a first sidewall and a second sidewall, said cast piece being received within said seat between said first sidewall and said second sidewall;

said slot has a center; and said cast piece hole is either aligned with said center whereby said stock has no cast, or offset from said center whereby said stock has an amount of cast.

5. The stock of claim 1 further comprising:

a comb supported by said frame and being vertically adjustable relative to said frame; and a rod anchor;

at least one rod connected to said rod anchor and movably connected to said frame; and a butt plate connected to said rod anchor and being vertically connected to said rod anchor.

6. A stock for a firearm with a receiver with a center line and a receiver rear face, the firearm further having a mount with a rear, said stock comprising:

a frame having a front riser;

an adapter with an adapter front face and an adapter rear face, said adapter front face having a profile corresponding to the receiver rear face, said adapter rear face mating with said front riser;

a cast piece with a cast piece hole, said cast piece being stationarily supported by said frame, the rear of the mount passing through said cast piece hole, the location of said cast piece hole with respect to the center line determines an amount of cast of said frame, wherein:

said adapter rear face has a cavity, a first pocket and a second pocket; and said front riser has a first tab and a second tab, said first tab being received in said first pocket and said second tab being received in said second pocket.

7. A stock for a firearm with a receiver with a center line and a receiver rear face, the firearm further having a mount with a rear, said stock comprising:

a frame having a front riser;

an adapter with an adapter front face and an adapter rear face, said adapter front face having a profile corresponding to the receiver rear face, said adapter rear face mating with said front riser;

a cast piece with a cast piece hole, said cast piece being stationarily supported by said frame, the rear of the mount passing through said cast piece hole, the location of said cast piece hole with respect to the center line determines an amount of cast of said frame, wherein:

said frame further has a rear riser, said rear riser having a slot therethrough; and said cast piece is stationarily supported by said rear riser, said cast piece hole being selectably aligned with said slot.

* * * * *